US011443733B2

(12) United States Patent
Chicote et al.

(10) Patent No.: US 11,443,733 B2
(45) **Date of Patent: *Sep. 13, 2022**

(54) CONTEXTUAL TEXT-TO-SPEECH PROCESSING

(71) Applicant: Amazon Technologies, Inc., Seattle, WA (US)

(72) Inventors: Roberto Barra Chicote, Cambridge (GB); Javier Latorre, Cambridge (GB); Adam Franciszek Nadolski, Gdansk (PL); Viacheslav Klimkov, Gdansk (PL); Thomas Edward Merritt, Cambridge (GB)

(73) Assignee: Amazon Technologies, Inc., Seattle, WA (US)

( * ) Notice: Subject to any disclaimer, the term of this patent is extended or adjusted under 35 U.S.C. 154(b) by 261 days.

This patent is subject to a terminal disclaimer.

(21) Appl. No.: 16/665,886

(22) Filed: Oct. 28, 2019

(65) Prior Publication Data

US 2020/0152169 A1 May 14, 2020

Related U.S. Application Data

(63) Continuation of application No. 15/447,919, filed on Mar. 2, 2017, now Pat. No. 10,475,438.

(51) Int. Cl.

| | |
|---|---|
| ***G10L 13/10*** | (2013.01) |
| ***G10L 13/033*** | (2013.01) |
| ***G10L 13/047*** | (2013.01) |

(52) U.S. Cl.
CPC ..... *G10L 13/10* (2013.01); *G10L 13/033* (2013.01); *G10L 13/047* (2013.01); *G10L 2013/105* (2013.01)

(58) Field of Classification Search
USPC ..... 704/7–10, 257–260
See application file for complete search history.

(56) References Cited

U.S. PATENT DOCUMENTS

| | | | | |
|---|---|---|---|---|
| 8,682,670 | B2 * | 3/2014 | Shechtman | G10L 13/033 704/260 |
| 2011/0191692 | A1 * | 8/2011 | Walsh | G06F 3/00 715/752 |
| 2012/0173959 | A1 * | 7/2012 | Spielberg | G10L 13/00 715/230 |
| 2012/0310649 | A1 * | 12/2012 | Cannistraro | G06F 16/685 704/260 |
| 2013/0013313 | A1 * | 1/2013 | Shechtman | G10L 13/033 704/260 |

(Continued)

*Primary Examiner* — Leonard Saint Cyr
(74) *Attorney, Agent, or Firm* — Pierce Atwood LLP

(57) ABSTRACT

A text-to-speech (TTS) system that is capable of considering characteristics of various portions of text data in order to create continuity between segments of synthesized speech. The system can analyze text portions of a work and create feature vectors including data corresponding to characteristics of the individual portions and/or the overall work. A TTS processing component can then consider feature vector(s) from other portions when performing TTS processing on text of a first portion, thus giving the TTS component some intelligence regarding other portions of the work, which can then result in more continuity between synthesized speech segments.

18 Claims, 15 Drawing Sheets

(56) References Cited

U.S. PATENT DOCUMENTS

| | | | | |
|---|---|---|---|---|
| 2014/0278429 | A1* | 9/2014 | Ganong, III | G06F 16/334<br>704/260 |
| 2014/0365860 | A1* | 12/2014 | Spielberg | G10L 15/26<br>715/230 |
| 2015/0058019 | A1* | 2/2015 | Chen | G10L 13/02<br>704/260 |

* cited by examiner

CONTEXTUAL TEXT-TO-SPEECH PROCESSING

CROSS-REFERENCE TO RELATED APPLICATION DATA

This application is a continuation of U.S. patent application Ser. No. 15/447,919, entitled "Contextual Text-To-Speech Processing," filed on Mar. 2, 2017, the contents of which is expressly incorporated herein by reference in its entirety.

BACKGROUND

Text-to-speech (TTS) systems convert written text to sound. This can be useful to assist users of digital text media with a visual impairment, dyslexia and other reading impairments, by synthesizing speech representing text displayed on a computer screen. Speech recognition systems have also progressed to the point where humans can interact with and control computing devices by voice. TTS and speech recognition combined with natural language understanding processing techniques enable speech-based user control and output of a computing device to perform tasks based on the user's spoken commands. The combination of speech recognition and natural language understanding processing is referred to herein as speech processing. Such TTS and speech processing may be used by computers, hand-held devices, telephone computer systems, kiosks, and a wide variety of other devices to improve human-computer interactions.

BRIEF DESCRIPTION OF DRAWINGS

For a more complete understanding of the present disclosure, reference is now made to the following description taken in conjunction with the accompanying drawings.

DETAILED DESCRIPTION

Figure 1:
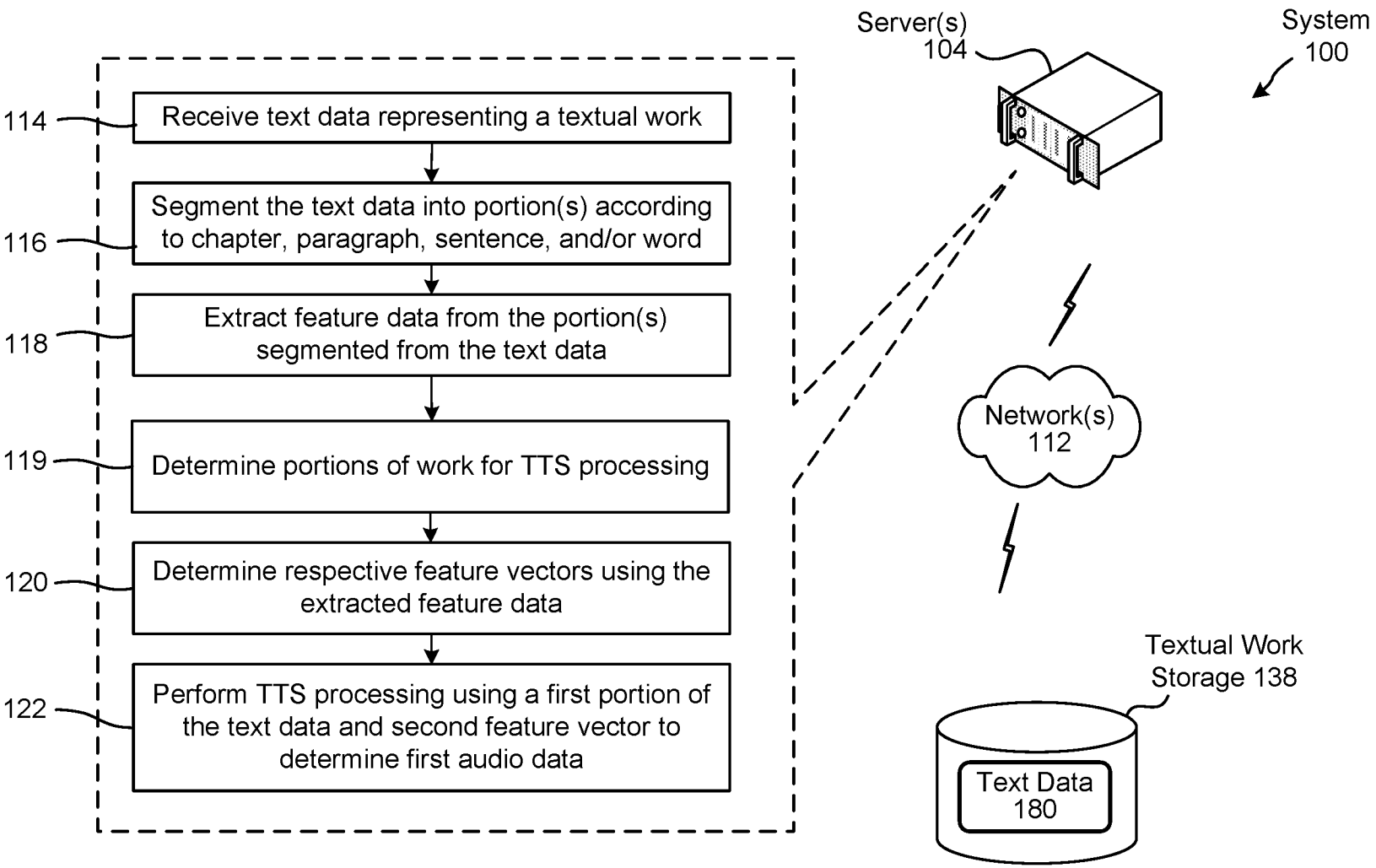
FIG. 1 illustrates an exemplary system overview according to embodiments of the present disclosure.

Electronic books (eBooks) and other text-based media in electronic form are commonly provided by publishers and distributers of text-based media. The eBooks are provided in electronic format e.g., .pdf, .ePub, .eReader, .docx, etc.), which file sizes may greatly vary in size (up to 1 GB). In certain situations a book may be specially read by a voice actor, whose recitation of the book is recorded for later playback. Such readings are sometimes referred to as "audiobooks" and may be accessed in various ways, including the software application Audible. Audiobooks may be provided in one of multiple different file formats (e.g., .mp3, .mp4, .mpeg, .wma, .m4a, .m4b, .m4p, etc.). Each file format may be in a different encoding or compatibility to provide security protocols to access the file or to allow the file to be played on a specific device with an applicable subscription. Such an audio recording may not be possible for every written work or it may be an additional cost for a user to buy a separate audiobook recording for a related eBook that the user already owns or otherwise has access to. For other works, the text of the works may be processed by software and output as readings or audible speech for a user to listen to. Speech audio data can be produced by software using a text-to-speech (TTS) approach, where text data corresponding to the text is converted to speech audio data and output as audio of the speech.

One issue with performing TTS processing on large textual works, such as eBooks, is how to segment a book or other work into portions in order to provide context so that the portions of the book are smaller and include contextual information to improve the efficiency of the TTS system. Some TTS systems may sound more natural when larger sections of text are input to be processed together. This is because these types of TTS systems can craft more natural sounding audio when it has information about the text surrounding the text that is being spoken. For example, TTS output corresponding to a word may sound more natural if the TTS system has information about the entire sentence in which the word appears. Similarly, TTS output corresponding to a sentence may sound more natural if the TTS system has information about the entire paragraph in which the sentence appears. Other textual characteristics, such as indications of dialog, chapter breaks, etc., if known to a TTS system, may allow the TTS system to create more natural sounding output audio.

Thus, it may be beneficial to for a system to take raw text from an electronic file that is unstructured (e.g., has limited data markings/offsets around the text) and identify such markings/offsets (for example, the chapters, paragraphs, etc.) as well as to identify certain characteristics about the text (e.g., a paragraph's nature and content, etc.). Then TTS processing can be performed on the segmented portions using the additional information to provide natural and pleasant audio data to a user device. However, it may also be undesirable to perform TTS processing on too large a portion of text. For example, if a user requests a 500 page book to be read aloud, it would consume unnecessary resources for the system to perform TTS processing on page 250 if the user is only currently listening to page 25. Thus, some processing is desired to chunk and parse the textual work for TTS processing purposes.

Further, TTS processing may occur serially, where the TTS processing for a portion of text to be read to a user (e.g., a first paragraph) is performed prior to beginning the TTS processing of a later portion of text to be read to a user (e.g., a second paragraph directly following a first paragraph). In such a configuration, there is no information about the second paragraph available to the TTS components when synthesizing audio for the first paragraph. While this may result in satisfactory results in certain situations, in other situations it may result in an inadequate user experience, particularly when the sound of the first paragraph may depend on some characteristic or content of the second paragraph.

As an example, if TTS processing is occurring on a document on a paragraph by paragraph basis, and a first paragraph of a work includes the text:

"Turn left here," he said.

synthesis of the text for that first paragraph input to a TTS component alone may result in normal sounding audio reading the paragraph as normal. However if the second paragraph includes the text:

"Now, or we all die!"

synthesis of the text for that second paragraph input to a TTS component alone may result in an excited sounding voice. The combination of audio of the first paragraph (in a normal voice) with audio of the second paragraph (in an excited voice) may result in a disjointed and undesirable customer experience. To avoid such an experience, it is desirable to provide some information to a TTS component about the context of particular text, and other portions of text that may precede or follow the text being synthesized, so that audio for the text being synthesized can join more appropriately with the audio for other text portions.

Offered are systems and methods to receive text data, determining portions of the text data, and performing TTS on one portion of the text data while considering data representing another portion of the text data. For example, a first text portion of the text data may be processed to generate at least one feature vector representing characteristics of the portion of text data that is processed. In other words, the text data may be processed to determine a first feature vector corresponding to first characteristics of the first text portion. The system and/or method may then perform text-to-speech (TTS) processing using a second text portion of the text data and the first feature vector to determine second audio data corresponding to the second text portion. Thus the system may determine audio corresponding to the second portion by considering not only the text of the second portion but also the first feature vector corresponding to characteristics of the first portion. While the first portion may appear in the text data directly before the second portion such an arrangement is not necessary. The first portion may be the portion of text following the second portion, and/or the first portion and second portion may not necessarily be contiguous in the text data and may be separated by other intermediate portions between the first and second portions.

A feature vector may be a n-dimensional vector of numerical features that represent some data. The numerical features may be used to facilitate processing and statistical analysis. For example, when representing text, the numerical features may represent term occurrence frequency, term count, sentence count, or other characteristics of text in a textual work. Feature vectors are often combined with weights using a dot product in order to construct a linear predictor function that is used to determine a score for making a prediction. The numerical features may be modified, formatted or converted to represent some variation of the numerical features that may be more appropriate or compatible for input to another component of the system. For example, a feature vector may be a 1-dimensional vector of numerical features corresponding to the occurrence frequency of a term. The term may be any word that appears in a textual work. The feature vector may also be a 2-dimensional vector of numerical features corresponding to other characteristics of a textual work and corresponding textual data.

Determining feature vectors of a portion of text may include extracting feature data from a first text portion and representing the extracted feature data as a numerical feature in an n-dimensional vector, wherein n is the number of unique features in the feature data. For example, a text portion may include four words and one word may appear twice in the text portion. A first numerical feature of the first text portion may be text portion length is four words. A second numerical feature of the first text portion may be a first word appears two times in the text portion. Therefore, the n-dimensional vector may be 2-dimensional because two unique features (1. length and 2. word occurrence frequency) were extracted from the first text portion.

The system may receive text data representing a textual work. The text data may be segmented into a portion(s) according to chapter, paragraph, sentence, and/or word or any other portion that is less than the whole text data. Feature data may be extracted from the portion(s) that have been segmented from the text data. The extracted feature data may correspond to characteristics of the respective portion(s) of the text data. Feature vectors may be determined using the extracted feature data. For example, text data may be segmented into at least a first portion and first feature data may be extracted from the first portion of the text data. A first feature vector may be determined using the first feature data. The first feature data may be representative of characteristics of the first portion of the text data. The feature vectors may be included with portions of text data in TTS processing to improve quality characteristics of speech as output audio.

In another example embodiment, the system may receive other data related to the text data. For example, the system may receive text data and audio data representing an audiobook, wherein the audio data may include non-speech audio representing a musical score or a soundtrack of the audiobook. For example, an audiobook may be accompanied by a musical score that can be heard in the background of the speech audio while being played on a listening device. The musical score may indicate a plurality of different moods and/or emphasis on particular portions of the audiobook. For example, the musical score may include a crescendo or decrescendo to indicate disambiguation between portions of the audiobook. The crescendo may indicate a portion of the audiobook where the plot is thickened or to bring an increased dramatic effect to the portion of speech audio that is being heard by the user. Alternatively, the musical score may include a decrescendo to indicate an anti-climactic point or moment in the audiobook.

The musical score may be analyzed and processed to extract other data, such as contextual data, that may be considered for TTS processing. The musical score contextual data may be time synchronized with the text data so that the system may associate the musical score with the corresponding text data. By associating the musical score with the corresponding text data, the system may adjust the output speech audio to correspond with the musical score to indicate a point of emphasis or some emotional adjustment to the output speech audio. For example, if the musical score includes a point of emphasis or crescendo associated with the text "watch out!", data corresponding to the crescendo may be processed by the TTS engine with the text data corresponding to the quoted text to generate output speech audio with an excited emphasis instead of a monotone or generic sounding voice. Other techniques may be used to confer emotional disambiguation in the musical score of the audiobook. Data corresponding to the emotional disambiguation may be extracted from the musical score and provided as an input to the TTS engine to improve the accuracy of how close to human-like the output speech audio sounds using the emotional disambiguation.

TTS processing may be performed on any combination of portions of text data and/or feature vectors to generate speech as output audio. Ideally, speech as output audio may be improved to sound how it is intended to sound in the original text of the text data representing the textual work. In other words, the more feature data is provided to generate feature vectors for inclusion in TTS processing with portions of text data, the more authentic and human-like the output speech audio will sound.

The TTS system may include various components for processing text for conversion into speech. A first component may convert raw text data into the equivalent of written out words. Additional processing (i.e., text normalization, pre-processing, tokenization, etc.) may be performed on the written out words (i.e., symbolic linguistic representations) before sending the result of such processing to another component of the TTS system. A second component may perform synthesis (conversion of the symbolic linguistic representation into sound or output audio) of the written out words to generate output audio data. Before the output audio data is sent to a transducer or speaker, the second component or another component may perform additional processing on the output audio data to manipulate how the output audio will sound to a listener. The larger the input text data is, the more computationally expensive this process may be. Such a system may be particularly useful for processing large quantities of text, as the system may segment the large passages into smaller portions based on context information extracted from the large passages. A further explanation of TTS processing can be found below in reference to FIGS. 9-12D.

In another embodiment, systems and methods are described for receiving text data representative of literary works and other large textual works (such as magazines, periodicals, web based publications and articles, websites, etc.) and segmenting the text data of the works according to chapters, paragraphs, sections of dialogue (such as multiple sequential lines of dialogue), and other contextual portions. Since TTS processing may depend on context, the larger the portions of text and/or appropriate context TTS processing is performed on, the more natural the resulting audio/speech corresponding to the text. In this respect, when a system or service desires to have a work (such as an electronic book) converted to output audio or read out loud by a device associated with the system, the systems and methods identify the work and perform a contextual analysis on the work. The systems and methods may also determine the work is a non-audio formatted electronic book. The systems and methods then segment the corresponding portions of the work according to chapters, paragraphs, sections of dialogue, and other contextual portions; and perform TTS processing on the portions to provide an output audio media file of the work to be available for access by the device.

The segmenting of the work may include determining a beginning of a paragraph as word number X, the total number of words in the paragraph, a last word of the paragraph as word number Y. Similarly, a beginning of a sentence, the total number of words in the sentence, an end of the sentence, and other information may be determined and used by the system. Using the chapter, paragraph, sentence, and word offsets, the systems and methods may also allow the user to fast forward or skip forward, or rewind or skip backwards by chapters, paragraphs, sentences, words, etc.

An exemplary system overview is described in reference to FIG. 1. As shown in FIG. 1, a system 100 may include a textual work storage database 138, one or more servers 104, and potentially other components. The textual work database 138 and the server(s) 104 may be in communication with one another over a network 112. The server(s) 104 may synthesize speech from text (i.e., perform TTS processing of text, such as text corresponding to a book) and send audio data corresponding to the text to a device associated with a requesting user.

As illustrated, the server(s) 104 may receive (114) text data 180 representing a textual work. The textual work may be in electronic format and may be received from the textual work database 138. The server(s) 104 may then segment (116) the work according to sections of the work, for example chapter, paragraph, sentence, word, and/or other structures. This segmenting may include inserting offsets identifying a beginning and end of a chapter, the number of paragraphs, the number of words, etc. within the chapter. The segmenting, may also include inserting offsets identifying a beginning and end of a paragraph, the number of sentences, the number of words, etc. within the paragraph. The segmenting may also include inserting offsets identifying a beginning and end of a sentence, the number of and the number of words, etc. within the sentence. For example, the offsets may correspond to: chapter 1 begins at word 1, chapter 1 ends at word 1,000, paragraph 1 begins at word 1, paragraph 1 ends at word 15, etc. The server(s) 104 may segment (116) the text data into portion(s) according to chapter, paragraph, sentence, and/or word. It should be appreciated that the segmented and insertion of offsets may only need to be performed once for each work. Thus, if the work identified has already been segmented, the segmented work including the offsets may be stored on the server(s) 104 and block 120 may be unnecessary.

The server(s) 104 may extract (118) feature data from the portion(s) segmented from the text data. The feature data may be representative of text characteristics of the portion(s) segmented from the text data. For example, text characteristics may include, letter spacing, line spacing, alignment, sentence length, or other such characteristics. The positioning of text, words, sentences and paragraphs in relation to the other text, words, sentences and paragraphs may also be determined as text characteristics. Furthermore, punctuations may also be used to determine text characteristics to communicate emphasis, pauses and other deviations from steady and non-emphasized speech. The server(s) 104 may process audio data into feature vectors (for example using an encoder or other component) and save that information further processing.

The above steps of segmenting and extracting feature data may happen in response to receiving a TTS request (for example a request to play back audio corresponding to a portion of a work) or may happen as part of a training or preliminary configuration processing to prepare the system for incoming TTS requests. In response to receiving a TTS request (or perhaps ahead of time) the server(s) 104 may determine (119) the relevant portions of the literary (textual) work to perform TTS processing on, such as the relevant chapter, section, or other text starting point. The segmenting and identification of offsets can be used to determine how much of the text of the work to process at a given time to result in high-quality audio output with the advent flow of the speaking voice while at the same time minimizing the use of unnecessary resources and allowing for general system performance. In one example, the server(s) 104 may determine to perform TTS processing on 1-6 paragraphs at a time, and process subsequent paragraphs (such as two additional paragraphs at a time) as needed. This may be appropriate because a TTS system can create TTS output audio data from input textual data faster than a playback device (such as user device) can actually play back the TTS output audio data. In other words, TTS processing may be faster than TTS playback. Thus, a TTS system may wish to only perform TTS processing on textual portions as the time approaches for playback of audio corresponding to those textual portions.

The server(s) 104 may determine (120) respective feature vectors for other portions using each of the extracted feature data. The feature vectors may correspond to sections of text other than the section about to be processed by a TTS component. For example, if a first portion of text is to be synthesized into speech, the system may identify feature vectors for portions that precede and/or follow the first portion (for example one portion directly preceding the first portion and one portion directly following the first portion). These feature vectors represent certain characteristics of the other portions of text that the system may consider when performing TTS processing on the first portion of text.

The server(s) 104 may then perform (122) TTS processing using a first portion of the text data to determine first audio data. The first audio data may be representative of the first portion of the text data. The TTS processing may use the feature vectors (such as a second feature vector corresponding to a first section) identified above in step 120 so that the system may consider certain characteristics of other portions when performing TTS processing of the first portion.

The server(s) 104 may also perform TTS processing using a second portion of the text data and a first feature vector (corresponding to a first portion of text) to determine second audio data corresponding to the second portion of text data. The TTS processing may be performed on any combination of a portion of text from the text data and a feature vector determined from feature data extracted from portions of text.

The process of extracting characteristics from a portion of text to create a feature vector may be referred to as encoding feature vectors. The encoded feature vector may represent the characteristics of the portion of text from which the characteristics were extracted. Feature vector encoding on text data may be performed in an amount of time that is less than the time it takes to perform TTS processing on the same text data. For example, TTS processing may require computing resources to first convert the text data to another form of data to perform comparison to stored speech data to determine the speech content of the text data. This step itself may include multiple intermediate steps which may require multiple different systems. Further, feature vector encoding may take less time than TTS processing because feature vector encoding may merely include steps to analyze the text data and determine characteristics of the text data for storage into a vector. For example, encoding a portion of text data corresponding to the text "she opened the door slowly," may include the following characteristics: "number of words: 5; subject: she (female); verb: opened; adverb: slowly; punctuations: one (comma after slowly); etc.," for example. The characteristics may include many types of grammatical, linguistic, numerical and other types of characteristics corresponding to the text data or the written work provided to the system. Each characteristic may be extracted and encoded into a feature vector corresponding to that portion of text data. Other characteristics may also be encoded.

Encoding feature vectors may be performed before or after the audio data is sent to the TTS engine for processing. For example, text data received for processing may be associated with a corresponding feature vector that may be accessible for inclusion into the TTS processing engine. Alternatively, the system may include a feature vector encoder to perform feature vector encoding on text data received for TTS processing. Once a portion of text is received for TTS processing, feature vector creation or encoding may be performed before the portion of text is processed so that the corresponding feature vector may be available for use prior to TTS processing is performed.

Since feature vector encoding may be performed significantly faster than TTS processing, feature vectors for audio data not yet ready for TTS processing may be created ahead of time to improve the performance of the TTS processing engine. For example, at a first time, a first portion of text data may be received for TTS processing. At a second time, feature vector encoding may be performed on the first portion of text data to create a first feature vector corresponding to the first portion of text data. Also, at the second time, TTS processing may be performed on the first portion of text data. The feature vector encoding may be completed before TTS processing on the first portion of text data is complete. Therefore, the first feature vector may be sent to the TTS engine to be included in the TTS processing of the first portion of the text data.

In another example, once the first feature vector has been determined, a second feature vector may be determined, using a second portion of text data, before or while TTS processing is being performed on the first portion of text data. Even further, a third feature may be determined, using a third portion of text data, before or while TTS processing is being performed on the first portion of text data. Feature vectors may be determined for additional portions of text data before TTS processing is complete on a previous portion of text data. Therefore, feature vectors corresponding to portions of text data that follow a first portion of text data may be included in TTS processing to quickly provide context corresponding to the portion of text data currently undergoing TTS processing. Providing the feature vectors for the portions of text data following the first portion of text data may significantly improve the outcome of TTS processing on the first portion of text data or any portion of text data in the stream of incoming portions of text data. This process of including feature vectors of portions of text data that follow the first portion of text data may also improve latency in the speech generated from TTS processing.

In yet another example, feature vectors corresponding to portions of text data that are between other portions of text data may be included in TTS processing. For example, a feature vector corresponding to a fifth portion of text data may be used in TTS processing of a third portion of text data. Alternatively, a feature vector corresponding to a third portion of text data may be used in TTS processing of a fifth portion of text data. Multiple feature vectors may be used in TTS processing of any one or more portion of text data. The more feature vectors used in TTS processing may increase the accuracy and/or quality of the speech generated from the TTS processing. However the number of feature vectors used in TTS processing may be balanced with the amount or quantity of time increase due to including the additional feature vectors.

The server(s) 104 may then store the audio output from the TTS system in the so that it may be retrieved by a user device or another device in communication with the server(s) 104 via the network(s) 112. To deliver the output audio created by a TTS process, the server(s) 104 may stream the audio output to a user device via an electronic communication or the server(s) 104 may provide a downloadable audio file (such as an mp3) the user device may download and play. In another example, the server(s) 104 may send a link, such as a URL, corresponding to the audio output of the TTS processing to the user device. The link or URL may point to a location where the audio output is stored. The user device may receive the URL and play the audio output corresponding to the relevant portions of the text of the work via speaker(s). It should be appreciated that the audio output may be played in substantially real-time and a first portion (such as a first sentence) of the relevant portion of the text of the work may be played while a second portion (such as a first sentence) of the relevant portion of the text of the work is being processed via TTS processing.

The server(s) 104 may repeat (the steps identified as block 114-122 above for subsequent sections of text, such as subsequent paragraphs, chapters, etc. For example, the subsequent sections of text may be processed via TTS processing prior to the prior section of text being played back.

The systems and methods disclosed herein allow for large textual works, such as works, to be read via an audio output to a user when the work has no corresponding pre-recorded audio version. This opens up the number of books, magazines, periodicals, web based publications and articles, websites, etc. a user can have delivered using audio output instead of textual output. The present system improves the output of such audio as the TTS processing for one section may consider the characteristics of one or more other sections, represented by feature vectors for those other sections.

Figure 2:
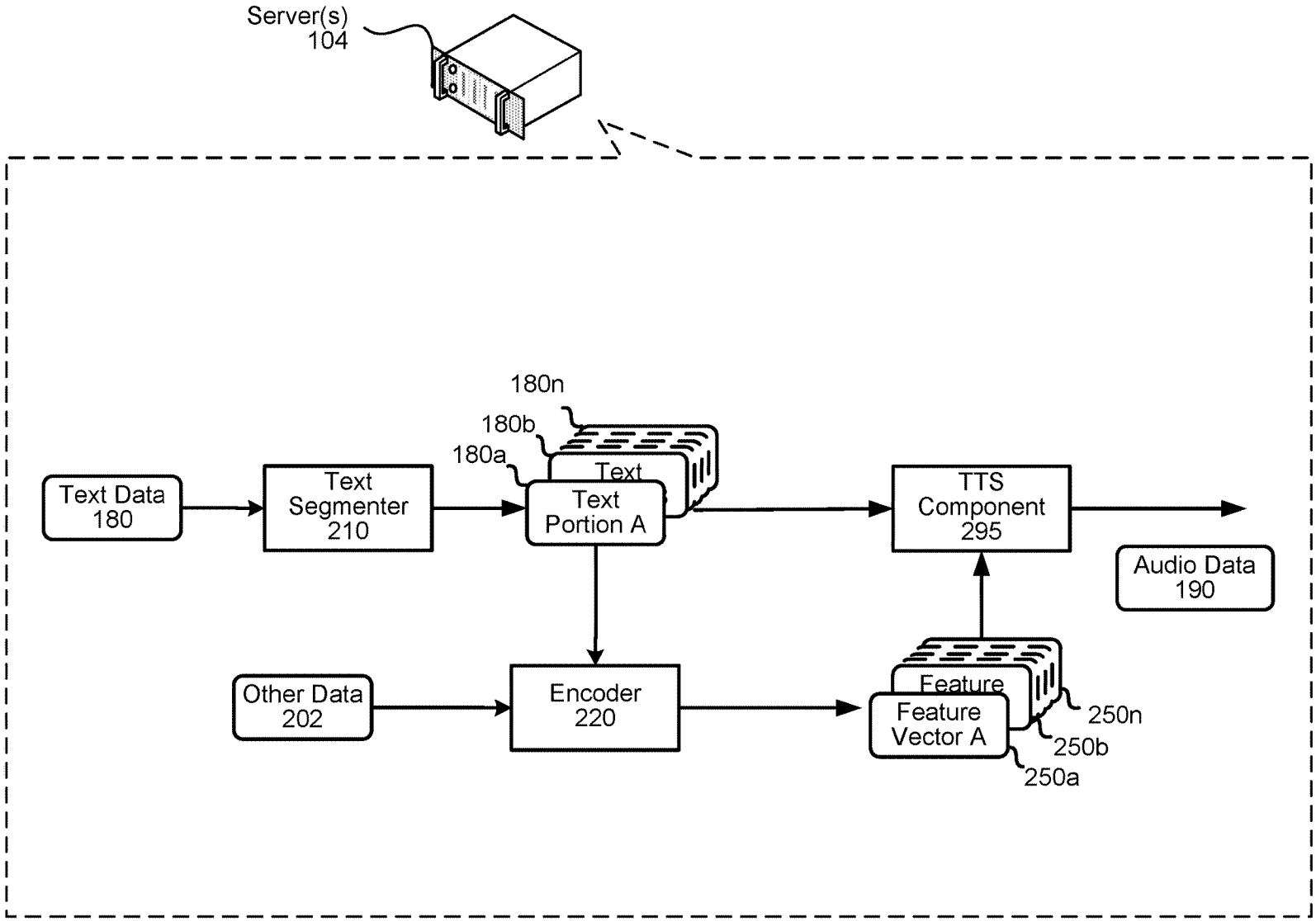
FIG. 2 illustrates components for receiving a literary work, segmenting the literary work into portions to perform TTS processing, characterizing those segments using data structures, and performing TTS processing using the data structures and text of the segments according to embodiments of the present disclosure.

The system 100 of FIG. 1 may operate using various components as described with regard to FIG. 2 and subsequent figures. FIG. 2 is a conceptual diagram of various components of a system for receiving an indication of a work to process using TTS processing and generate an audio output, according to embodiments of the present disclosure. The various components illustrated may be located on a same or different physical devices. Communication between various components illustrated in FIG. 2 may occur directly or across the network 112.

As shown in FIG. 2, the server(s) 104 may include various components, such as a text segmenter 210, encoder 220, and TTS component 295. The text segmenter 210 receives text data 180 corresponding to a work and segments the text into portions, such as Text Portions A 180*a* through Text Portions N 180*n*. The text portions 180*x* do not necessarily have to be the same size and may be different sizes or units (for example one portion may be a sentence, another portion may be a paragraph, another portion may be a chapter, or the like). Segmenting and other operations relating to the text data is discussed below in reference to FIGS. 3-7. The text portions 180*x* (and other data 202) may be sent to encoder 220. The encoder 220 (or other such component) may then output data representing characteristics of each text portion. For example, the encoder 220 may output feature vector A 250*a* through feature vector N 250*n* where each feature vector represents characteristics of the respective text portion (e.g., feature vector A 250*a* represents characteristics of text portion A 180*a*). Operation of the encoder 220 is discussed below in reference to FIG. 8. A text portion 180*x* for a first text portion may then be processed by TTS component 295 along with one or more individual feature vectors 250*x* (corresponding to other text portions) to create audio data 190 corresponding to synthesized speech of the first text portion. Further discussion of the TTS processing is discussed below in reference to FIGS. 9-12D.

Figure 3:
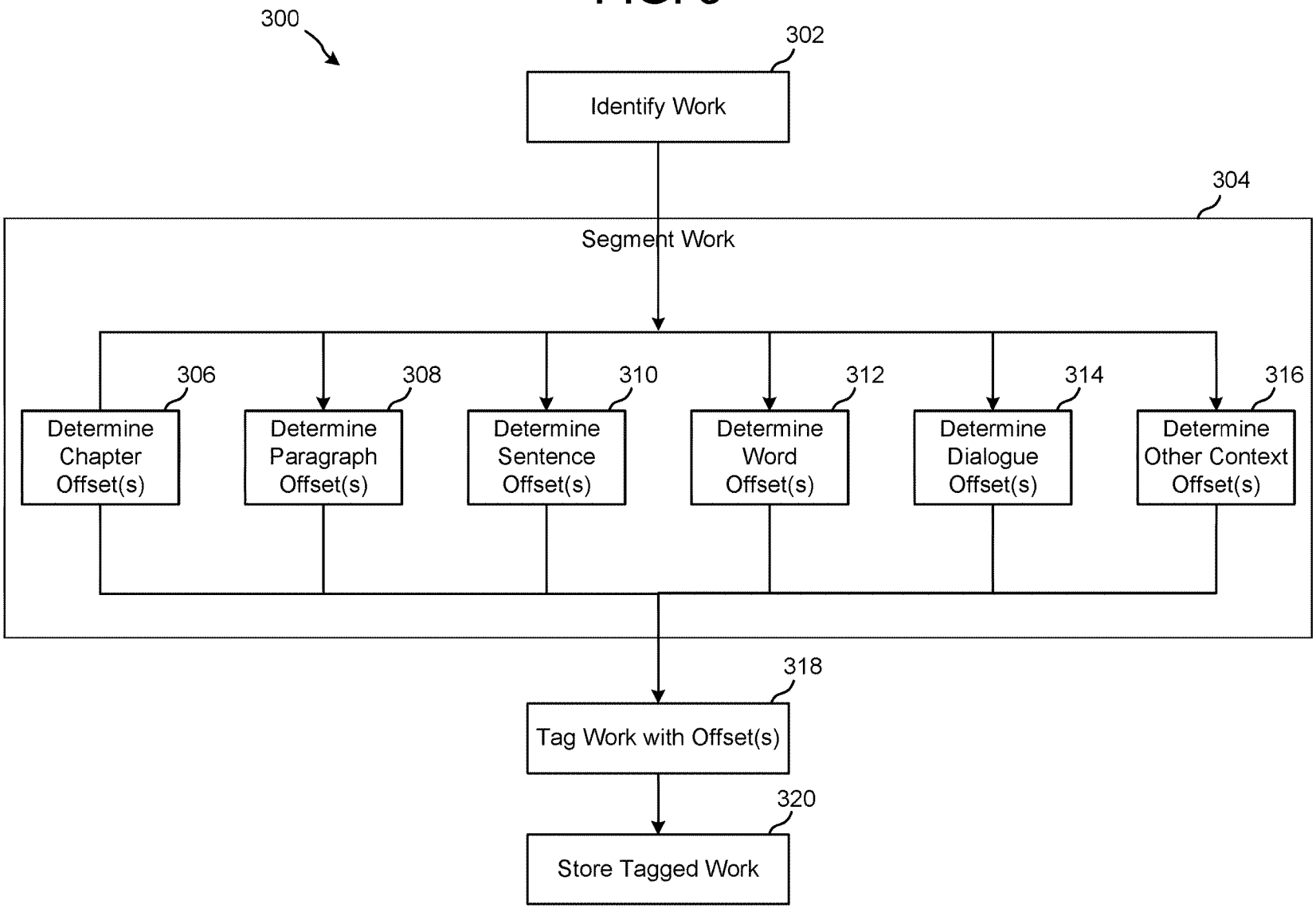
FIG. 3 illustrates segmenting of a work according to embodiments of the present disclosure.

FIG. 3 is a flow diagram 300 illustrating segmenting of a work that may be performed by a text segmenter 210 according to embodiments of the present disclosure. As shown, the system may identify a textual work, illustrated as block 302. This may be any type of textual work, including works, books, articles, etc. For illustrative purposes, a work is used as an example. The system then segments the work to determine offsets, illustrated as block 304.

The system may determine chapter offsets, illustrated as block 306. The chapter offsets may correspond to a count of words that the chapter begins with and ends with. For example, chapter 1 begins at word 1 and chapter 1 ends at word 1,000, chapter 2 begins at word 1,001 and chapter 2 ends at word 2,500, etc.

The system may determine paragraph offsets, illustrated as block 308. The paragraph offsets may correspond to a count of words that the paragraph begins with and ends with. For example, paragraph 1 begins at word 1 and paragraph 1 ends at word 50; paragraph 2 begins at word 51 and paragraph 2 ends at word 150, etc.

The system may determine sentence offsets, illustrated as block 310. The sentence offsets may correspond to a count of words that the sentence begins with and ends with. For example, sentence 1 begins at word 1 and sentence 1 ends at word 10; sentence 2 begins at word 11 and sentence 2 ends at word 25, etc.

The system may determine word offsets, illustrated as block 312. The word offsets may correspond to a count of the words, with each word increasing by one in consecutive order. For example, word 1, word 2, . . . word 1,000, etc. of the work.

The system may determine dialogue offsets, illustrated as block 314. The dialogue offsets may correspond to a count of words that the section of dialogue begins with and ends with. For example, dialogue section 1 begins at word 3,000 and dialogue section 1 ends at word 3,050; dialogue section 2 begins at word 4,025 and dialogue section 2 ends at word 4,075, etc. The separate dialogue sections may be useful to group together and TTS processing performed on the whole dialogue section to provide context, as a single dialogue section may include multiple short paragraphs that if TTS processing was performed on separately may result in undesirable audio output.

The system may also determine other context type offsets, illustrated as block 316. These contexts may also correspond to a count of words that the section of context begins with and ends with as described above. Context can be thought of as relevant constraints of the communicative situation that influence language use and language variation, such as a certain character's point of view of a situation for example. As an example, a written work may contain certain text that is set apart from other text, such as an aside (which may be indicated by italicized or offset text), a note to a reader (which may be included in brackets or parenthesis), a table of contents, an appendix, a prologue, and introduction, etc. Such contexts may alter a desired audio reading of the text, and thus indications of the context may be used by the downstream TTS process. By identifying different contexts and situations within the work using offsets, the system can group together context sections, which may include multiple paragraphs, and perform TTS processing on entire context sections to provide higher quality audio output results. The system may also choose to forego performing TTS processing on certain context sections, such as a table of contents, etc., as such sections may be immaterial or irrelevant to the user.

The system may tag the work with one or more of the types of offsets described above, illustrated as block 318, and store the tagged work in a database, illustrated as block 320. The tagged work may include the text corresponding to the words of the work as well as textual indicators (i.e., tags) that are not read aloud but are used by a downstream process (for example, the TTS engine 214) to indicate chapters, paragraphs, sentences, etc. It should be appreciated that a number of works and other textual works may be available, and the system may only have to parse, tag, and store each one once. This allows the system to access the already parsed and tagged works as needed in response to a request in order to have groups of the text processed using the TTS processing techniques described above.

Figure 4:
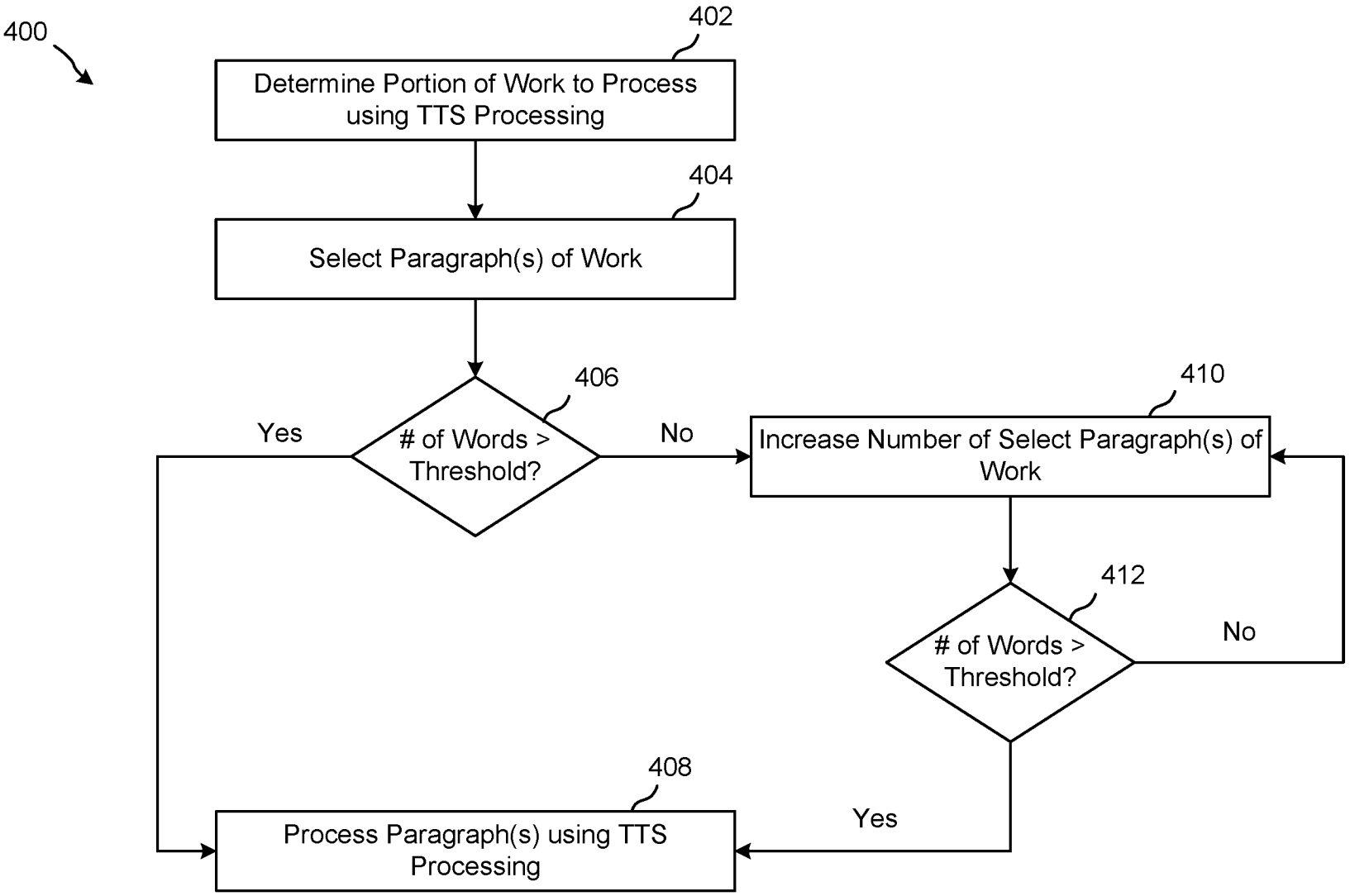
FIG. 4 illustrates determining which portions of the work to process using TTS processing based on paragraphs and an amount of words according to embodiments of the present disclosure.
Figure 5:
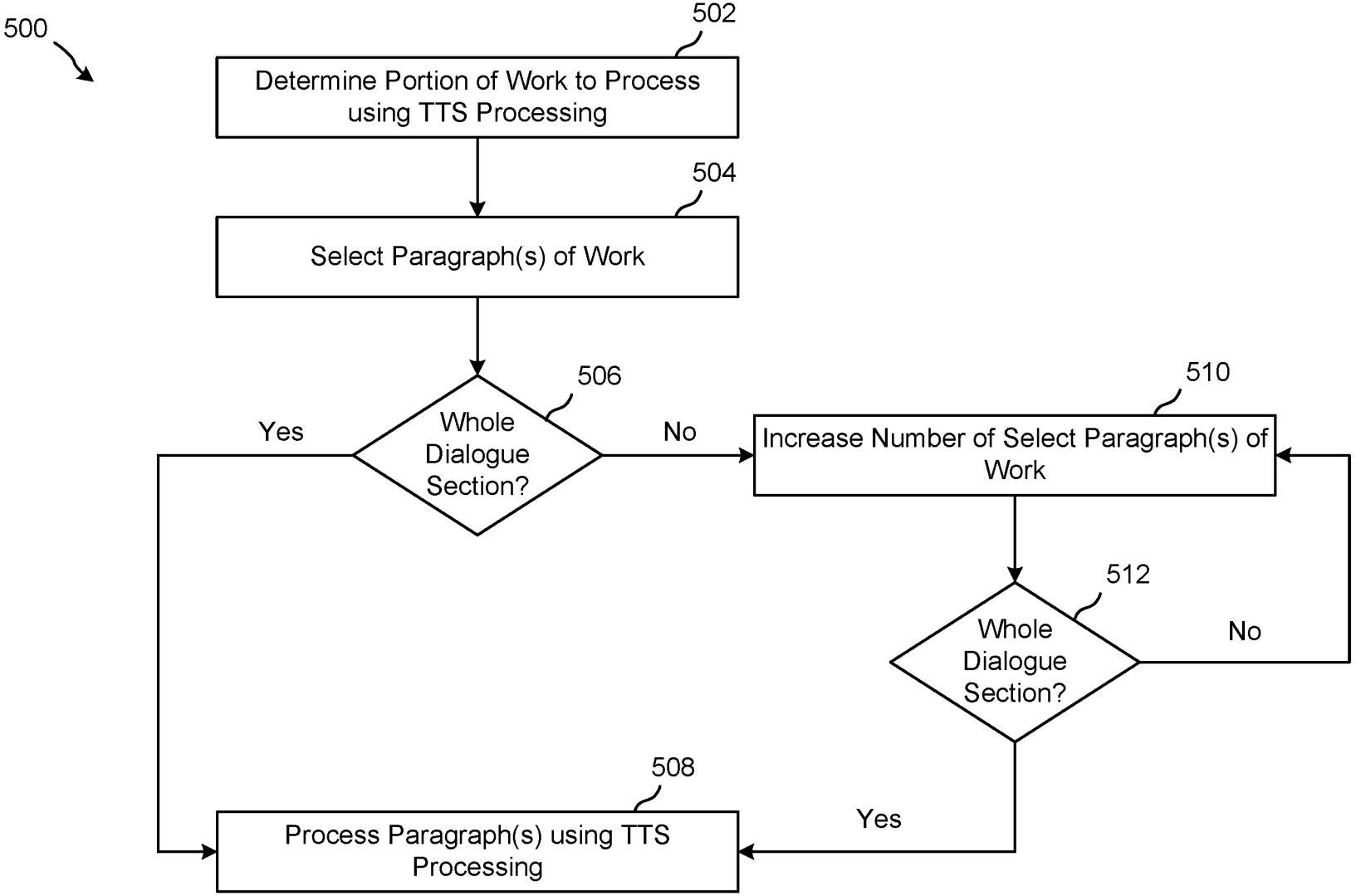
FIG. 5 illustrates determining which portions of the work to process using TTS processing based on dialogue section according to embodiments of the present disclosure.
Figure 6:
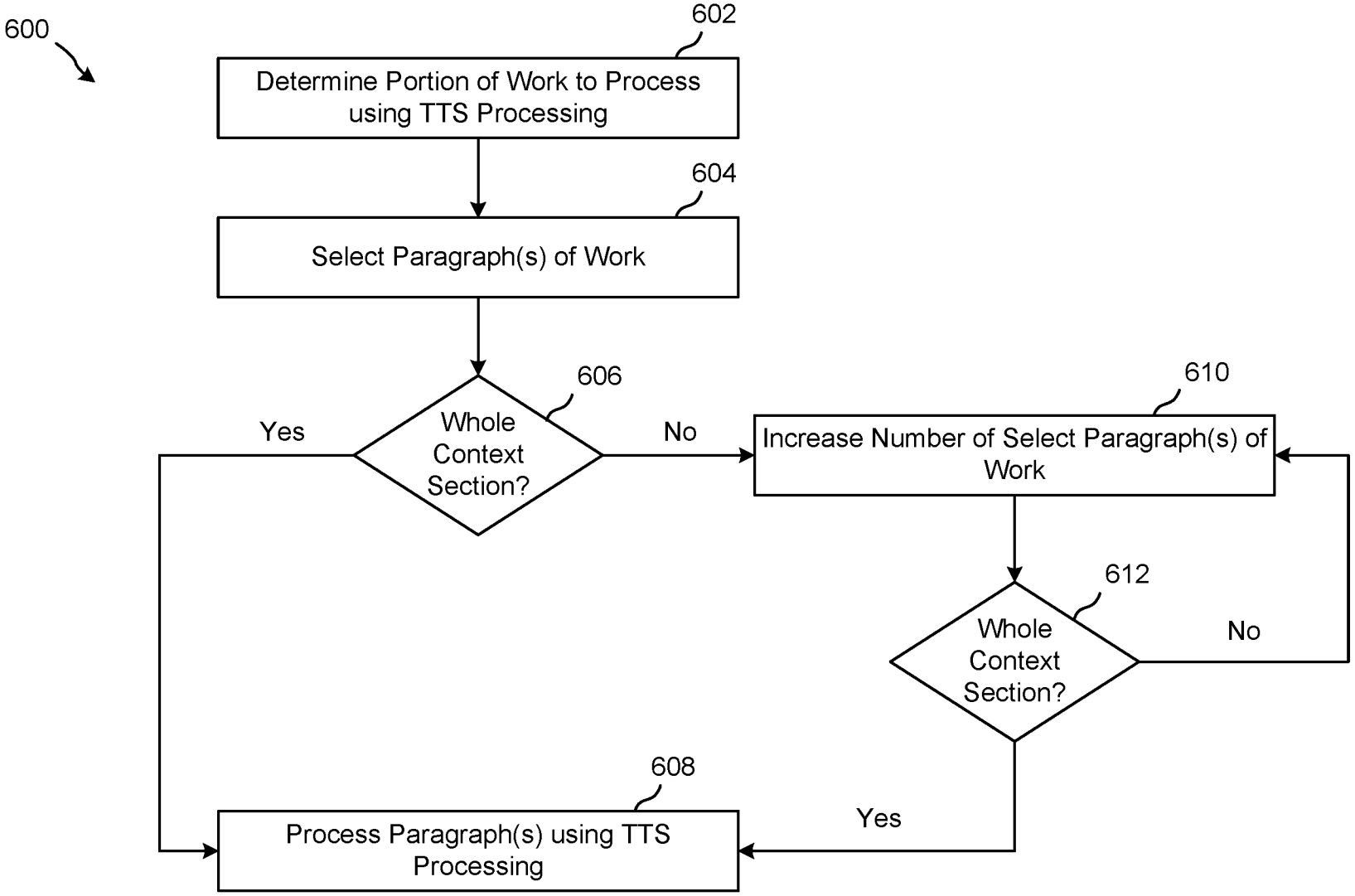
FIG. 6 illustrates determining which portions of the work to process using TTS processing based on context section according to embodiments of the present disclosure.

FIGS. 4-6 are flow diagrams illustrating determining which contextual portions of the work to process using TTS processing as may be performed by a text segmenter 210 according to embodiments of the present disclosure. In general, TTS processing produces higher quality, more natural audio output with increasing amounts of content. To provide high quality, natural audio output, the amount of text selected for TTS processing is selected by the system according to varying degrees of constraints to ensure the text being processed via TTS processing includes a sufficient amount of context.

FIG. 4 is a flow diagram 400 illustrating determining which portions of the work to process together using TTS processing based on paragraphs and an amount of words according to embodiments of the present disclosure. This may assist the system in selecting sufficient text for processing so as to maintain some eventual audio continuity between the sections when processing text in chunks. As shown, the system may determine a portion of the work to process using TTS processing, illustrated as block 402. This determination may include the system selecting one or more paragraphs of the work, illustrated as block 404. It should be appreciated that the selected paragraphs may correspond to a position in the work where the user last left off based on information in the user's profile. The system may then determine whether the number of words contained within the selected paragraph(s) is greater than a threshold number, illustrated as block 406. This threshold may be set as a specific number (such as 100 words, or more or less than 100 words), or may be dynamic based on quality of the results of TTS processing. For example, the system may be trained to select the number of words based on past selections and the resulting quality of the TTS processing.

When the number of words contained within the selected paragraph(s) is greater than the threshold, the system may proceed to process the selected paragraph(s) using TTS processing to product an audio output, illustrated as block 408. When the number of words contained within the selected paragraph(s) is less than the threshold, the system may increase the number of paragraph(s) selected, illustrated as block 410. This may include increasing the paragraph(s) selected by selecting another one or more paragraphs following the previously selected paragraph(s), selecting another one or more paragraphs preceding the previously selected paragraph(s), or both.

The system may then determine whether the number of words contained within the paragraph(s) is greater than the threshold number, illustrated as block 412. When the number of words contained within the paragraph(s) is greater than the threshold, the system may proceed to process the selected paragraph(s) using TTS processing to product an audio output, illustrated as block 408. When the number of words contained within the selected paragraph(s) is less than the threshold, the system may proceed back to block 410.

FIG. 5 is a flow diagram 500 illustrating determining which portions of the work to process using TTS processing based on dialogue section according to embodiments of the present disclosure. As shown, the system may determine a portion of the work to process using TTS processing, illustrated as block 502 similar to block 402 above. This determination may include the system selecting one or more paragraphs of the work, illustrated as block 504 similar to block 404 above. The system may then determine whether the selected paragraph(s) correspond to an entire dialogue section or only a portion of a dialogue section, illustrated as block 506. This ensures that portions of a dialogue are not left out, which could impact the context of the dialogue.

When the selected paragraph(s) correspond to an entire dialogue section, the system may proceed to process the selected paragraph(s) using TTS processing to product an audio output, illustrated as block 508. When the selected paragraph(s) correspond to only a portion of a dialogue section, the system may increase the number of paragraph(s) selected, illustrated as block 510. This may include increasing the paragraph(s) selected by selecting another one or more paragraphs following the previously selected paragraph(s), selecting another one or more paragraphs preceding the previously selected paragraph(s), or both.

The system may then determine whether the selected paragraph(s) correspond to the entire dialogue section or only a portion of the dialogue section, illustrated as block 512. When the paragraph(s) correspond to the entire dialogue section, the system may proceed to process the selected paragraph(s) using TTS processing to product an audio output, illustrated as block 508. When the paragraph(s) correspond to only a portion of a dialogue section, the system may proceed back to block 510.

FIG. 6 is a flow diagram 600 illustrating determining which portions of the work to process using TTS processing based on context section according to embodiments of the present disclosure. As shown, the system may determine a portion of the work to process using TTS processing, illustrated as block 602 similar to block 402 above. This determination may include the system selecting one or more paragraphs of the work, illustrated as block 604 similar to block 404 above. The system may then determine whether the selected paragraph(s) correspond to an entire context section or only a portion of a context section, illustrated as block 606. This ensures that portions of a context section are not left out, which could impact the TTS processing.

When the selected paragraph(s) correspond to an entire context section, the system may proceed to process the selected paragraph(s) using TTS processing to product an audio output, illustrated as block 608. When the selected paragraph(s) correspond to only a portion of a context section, the system may increase the number of paragraph(s)

selected, illustrated as block 610. This may include increasing the paragraph(s) selected by selecting another one or more paragraphs following the previously selected paragraph(s), selecting another one or more paragraphs preceding the previously selected paragraph(s), or both.

The system may then determine whether the selected paragraph(s) correspond to the entire context section or only a portion of the context section, illustrated as block 612. When the paragraph(s) correspond to the entire context section, the system may proceed to process the selected paragraph(s) using TTS processing to produce an audio output, illustrated as block 608. When the paragraph(s) correspond to only a portion of a context section, the system may proceed back to block 610.

Figure 7:
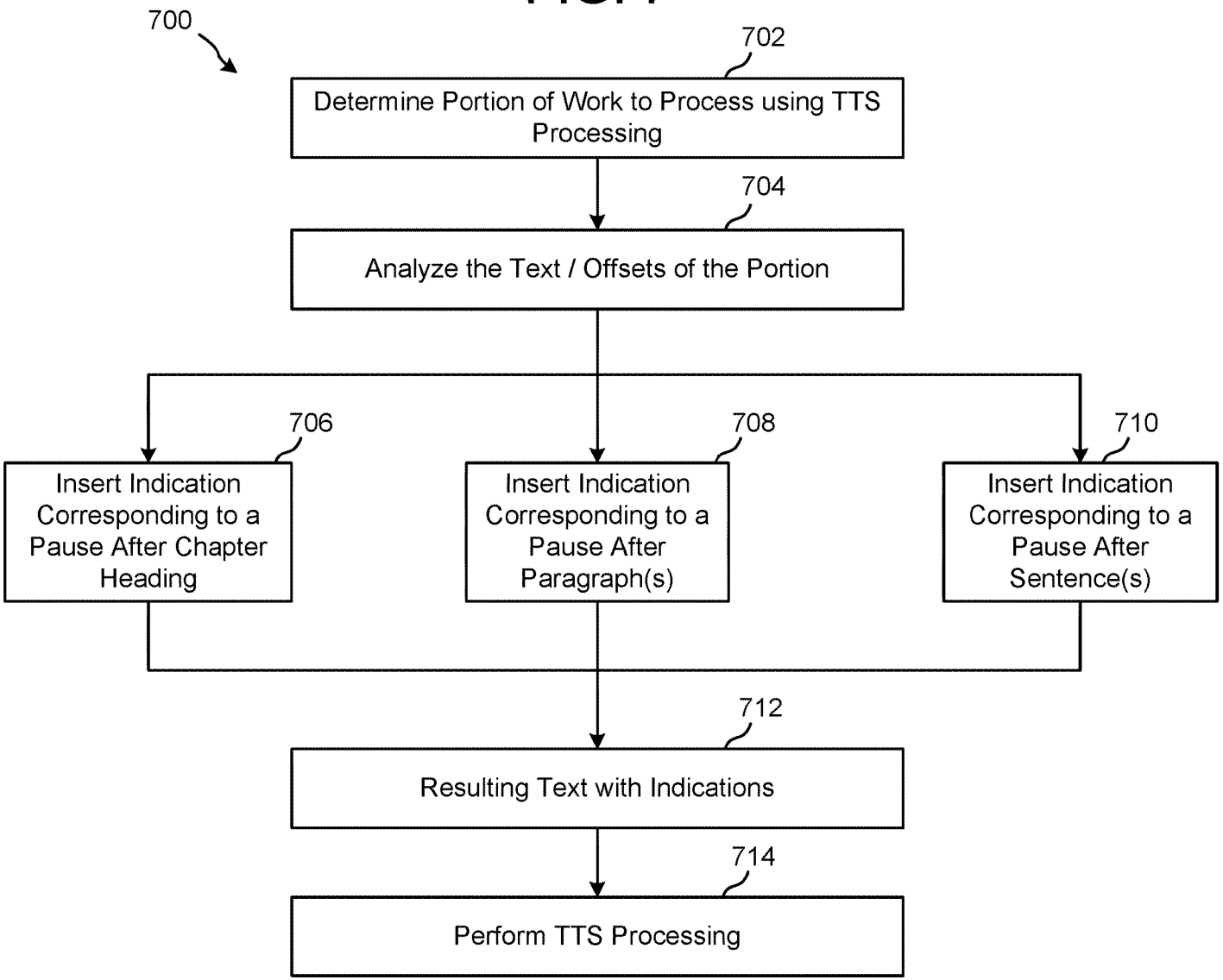
FIG. 7 illustrates insertion of indications of pauses according to embodiments of the present disclosure.

When TTS processing does not have enough content or text to process, the audio output may cause chapter titles, paragraphs, and/or sentences to run together without appropriate intervening pauses. To cure this issue, an indication may be inserted into the text to cause pauses to be implemented during TTS processing. The pause lengths may vary from short pauses (for example about 500 milliseconds) to longer pauses (for example 1 second or more). The different length pauses may be used based on the context of the text, for example a sentence break may call for a shorter pause than a paragraph break, which may call for a shorter pause than a chapter break, etc. FIG. 7 is a flow diagram 700 illustrating insertion of indications of pauses according to embodiments of the present disclosure. As shown, the system may determine a portion of the work to process using TTS processing, illustrated as block 702. It should be appreciated that the portion may correspond to a position in the work where the user last left off based on information in the user's profile.

The system may analyze the text and offsets of the portion, illustrated as block 704. The system may then optionally insert an indication corresponding to a pause after one or more chapter headings, illustrated as block 706. The system may optionally insert an indication corresponding to a pause after one or more paragraphs, illustrated as block 708. The system may optionally insert an indication corresponding to a pause after one or more sentences, illustrated as block 710.

When the system is finished inserting the indications corresponding to the pauses, the resulting text of the portion of the work with the indications, illustrated as block 712 may be used to perform TTS processing on the portion with the indications, illustrated as block 714. The indication corresponding to the pauses may instruct the TTS processing to insert a pause, for example of about 500 milliseconds or larger into the audio output. This may cause the audio output to pause, for example after the chapter heading (i.e., Chapter One) prior to starting the first paragraph of the chapter, etc. This may result in a more natural audio output of the portion of the work.

The resulting text of the portion of the work with the indications may be cached or stored. For example, cached text with indications may remain available for less than about 2 days, while stored text with indication may remain in a data store for a longer period of time.

All of the methods describe with reference to FIGS. 4-7 may be combined with one another to increase the quality of the TTS processing as deemed necessary.

To avoid latency issues with a TTS request involving a long passage (such as a chapter of a book) which may take a long time to synthesize and to eventually get audio data to a user, the TTS system reduces the time response splitting the target passage (i.e., a long paragraph consisting of several long complex sentences) into segments (i.e., phrases) that represent each of segments with a sentence embedding or vector. The segments can then be processed by a TTS component individually so as to get audio to a user more quickly. Examples of determining the segments are explained in reference to FIGS. 3-7. To properly synthesize a whole passage in a satisfactory way it is important in order to understand the context of one segment of a passage relative to other segments so the TTS system can interpret the target segment(s) and passage in a natural way.

However, considering the whole passage in TTS modeling and the prediction at one time makes the synthesis slow. To improve contextual understanding, the present system processes information about the text segments and makes that information available to a TTS component so that the TTS component may consider characteristics of text portions other than the portion being processed, when synthesizing audio for the portion being processed. Thus the system may gather linguistic, semantic and/or other information from portions that can be used when synthesizing portions of a whole passage. A segment embedding (generated as a latent representation of that segment) may be used as an input to the prediction for the next segment. This way, during the prediction of the current segment, the sentence embedding is generated and the next segment prediction can be started, before the current one has been finished.

Figure 8:
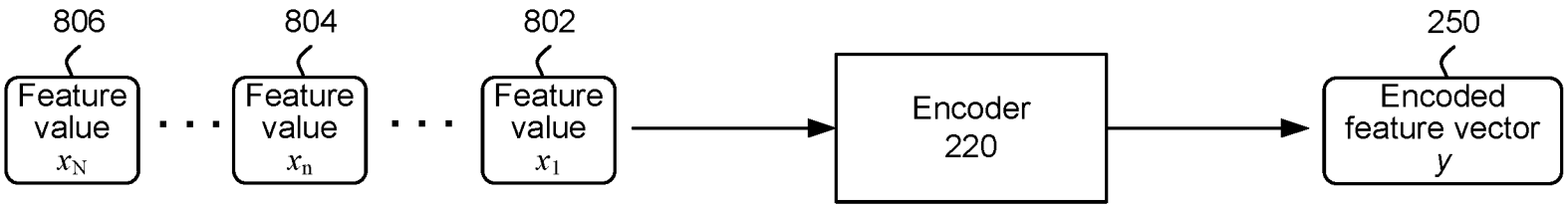
FIG. 8 illustrates operation of an encoder according to embodiments of the present disclosure.

To create a representation of the characteristics of a text segment, the system may use a component such as an encoder, shown in FIG. 8. In mathematical notation, given a sequence of feature data values $x_1, \ldots x_n, \ldots x_N$, with $x_n$ being a D-dimensional vector, an encoder $E(x_1, x_N)=y$ projects the feature sequence to y, with y being a F-dimensional vector. F is a fixed length of the vector and is configurable depending on user of the encoded vector and other system configurations. For example, F may be between 100 and 1000 values related to different characteristics of a text portion, but any size may be used. Any particular encoder 220 will be configured to output vectors of the same size, thus ensuring a continuity of output encoded vector size from any particular encoder 220 (though different encoders may output vectors different fixed sizes). The value y may be called an embedding of the sequence $x_1, \ldots x_N$. The length of $x_n$, and y are fixed and known a-priori, but the length of N of feature sequence $x_1, \ldots x_N$ is not necessarily known a-priori. The encoder E may be implemented as a recurrent neural network (RNN), for example as an long short-term memory RNN (LSTM-RNN) or as a gated recurrent unit RNN (GRU-RNN). An RNN is a tool whereby a network of nodes may be represented numerically and where each node representation includes information about the preceding portions of the network. For example, the RNN performs a linear transformation of the sequence of feature vectors which converts the sequence into a fixed size vector. The resulting vector maintains features of the sequence in reduced vector space that can otherwise be arbitrarily long. The output of the RNN after consuming the sequence of feature data values is the encoder output. There are a variety of ways for the RNN encoder to consume the encoder output, including but not limited to:

- linear, one direction (forward or backward),
- bi-linear, essentially the concatenation of a forward and a backward embedding, or
- tree, based on parse-tree of the sequence, In addition, an attention model can be used, which is another RNN or DNN that learns to "attract" attention to certain parts of the input. The attention model can be used in combination with the above methods of consuming the input.

FIG. 8 illustrates operation of an encoder 220. The input feature value sequence, starting with feature value $x_1$ 802, continuing through feature value $x_n$ 804 and concluding with feature value $x_N$ 806 is input into the encoder 220. The RNN encoder 220 may process the input feature values as noted above. The encoder 220 outputs the encoded feature vector y 250, which is a fixed length feature vector of length F. An encoder such as 220 may be used with speech processing.

The feature values 802-806 may represent certain characteristics of the text data. The characteristics may be portion-level characteristics (e.g., related to just the portion of text that will be represented by encoded feature vector y 250), may be work-level characteristics (e.g., related to the work as a whole represented), or may be some other level of characteristics. Characteristics may include for example, data regarding letter spacing, line spacing, alignment, positioning of text, words, sentences and paragraphs in relation to the other text, emphasis, pauses, content, author data, character data, or other data that may be useful in providing context for a TTS component.

Other kinds of characteristics may include features that represent the text data (text features) and features that represent how speech output (speech features) output from the TTS component for a particular text portion should sound. Characteristics representing the relationship between the text features and the speech features may be encoded into another feature vector representing to the relationship. Encoding the relationship between the text features and the speech features may be done during training. In other words, an intermediate layer may be used during the TTS processing to represent the encoded relationship between the input features (text features) and the output features (speech features). During the synthesizing process, linguistic features may be used to generate the output audio, wherein the output audio generated using the linguistic features may more accurately sound like how the portion of text data was intended to sound.

The encoder RNN may be trained using known techniques, for example the stochastic gradient descent (SGD) method with the backpropagation-through-time (BTT) algorithm to propagate an error signal through the sequence thereby learning the parameters of the encoder network. The encoded feature vector y 250 may then be used by a TTS component 295 as described below.

Figure 9:
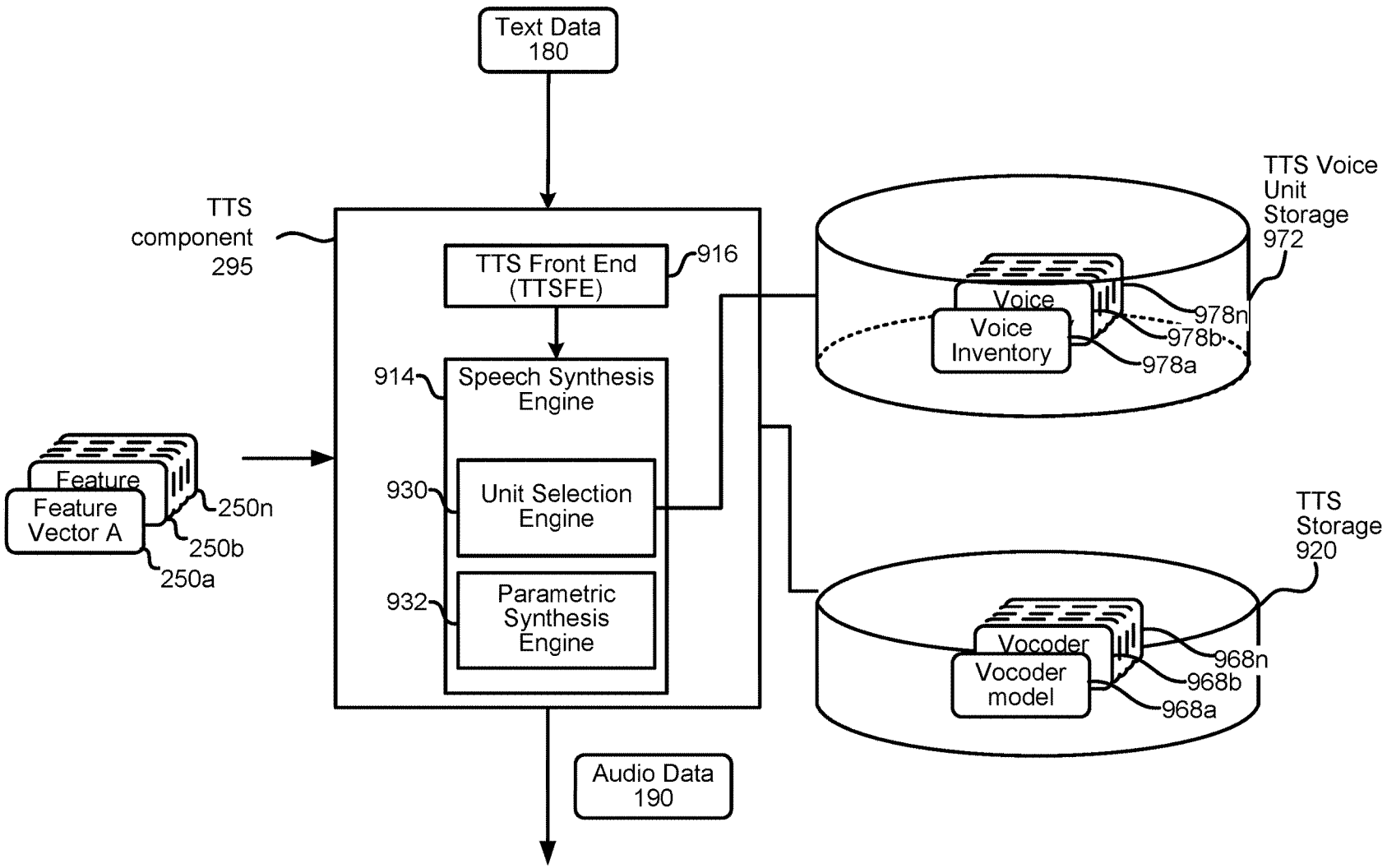
FIG. 9 illustrates components for performing TTS processing, according to embodiments of the present disclosure.

Components that may be used to perform TTS processing are shown in FIG. 9. As shown in FIG. 9, the TTS component/processor 295 may include a TTS front end (TTSFE) 916, a speech synthesis engine 914, and TTS storage 920. The TTS storage 920 may include, among other things, vocoder models **968*a*-968*n* that may be used by the parametric synthesis engine 932 when performing parametric synthesis. The TTSFE 914 transforms input text data (for example from command processor 290) into a symbolic linguistic representation for processing by the speech synthesis engine 914. The TTSFE 916 may also process tags or other data input to the TTS component 295 that indicate how specific words should be pronounced. The speech synthesis engine 914 compares the annotated phonetic units models and information stored in the TTS storage 920 for converting the input text into speech. The TTSFE 916 and speech synthesis engine 914 may include their own controller(s)/processor(s) and memory or they may use the controller/processor and memory of the server 104, device 110, or other device, for example. Similarly, the instructions for operating the TTSFE 916 and speech synthesis engine 914 may be located within the TTS component 9295, within the memory and/or storage of the server 120, device 110**, or within an external device.

Text input into a TTS component 9295 may be sent to the TTSFE 916 for processing. The front-end may include components for performing text normalization, linguistic analysis, and linguistic prosody generation. During text normalization, the TTSFE processes the text input and generates standard text, converting such things as numbers, abbreviations (such as Apt., St., etc.), symbols ($, %, etc.) into the equivalent of written out words.

During linguistic analysis the TTSFE 916 analyzes the language in the normalized text to generate a sequence of phonetic units corresponding to the input text. This process may be referred to as grapheme to phoneme conversion. Phonetic units include symbolic representations of sound units to be eventually combined and output by the system as speech. Various sound units may be used for dividing text for purposes of speech synthesis. A TTS component 295 may process speech based on phonemes (individual sounds), half-phonemes, di-phones (the last half of one phoneme coupled with the first half of the adjacent phoneme), bi-phones (two consecutive phonemes), syllables, words, phrases, sentences, or other units. Each word may be mapped to one or more phonetic units. Such mapping may be performed using a language dictionary stored by the system, for example in the TTS storage component 295. The linguistic analysis performed by the TTSFE 916 may also identify different grammatical components such as prefixes, suffixes, phrases, punctuation, syntactic boundaries, or the like. Such grammatical components may be used by the TTS component 295 to craft a natural sounding audio waveform output. The language dictionary may also include letter-to-sound rules and other tools that may be used to pronounce previously unidentified words or letter combinations that may be encountered by the TTS component 295. Generally, the more information included in the language dictionary, the higher quality the speech output.

Based on the linguistic analysis the TTSFE 916 may then perform linguistic prosody generation where the phonetic units are annotated with desired prosodic characteristics, also called acoustic features, which indicate how the desired phonetic units are to be pronounced in the eventual output speech. During this stage the TTSFE 916 may consider and incorporate any prosodic annotations that accompanied the text input to the TTS component 295. Such acoustic features may include pitch, energy, duration, and the like. Application of acoustic features may be based on prosodic models available to the TTS component 295. Such prosodic models indicate how specific phonetic units are to be pronounced in certain circumstances. A prosodic model may consider, for example, a phoneme's position in a syllable, a syllable's position in a word, a word's position in a sentence or phrase, neighboring phonetic units, etc. As with the language dictionary, prosodic model with more information may result in higher quality speech output than prosodic models with less information. Further, a prosodic model and/or phonetic units may be used to indicate particular speech qualities of the speech to be synthesized, where those speech qualities may match the speech qualities of input speech (for example, the phonetic units may indicate prosodic characteristics to make the ultimately synthesized speech sound like a whisper based on the input speech being whispered).

The output of the TTSFE 916, referred to as a symbolic linguistic representation, may include a sequence of phonetic units annotated with prosodic characteristics. This symbolic linguistic representation may be sent to a speech synthesis engine 914, also known as a synthesizer, for conversion into an audio waveform of speech for output to an audio output device and eventually to a user. The speech synthesis engine 914 may be configured to convert the input text into high-quality natural-sounding speech in an efficient manner. Such high-quality speech may be configured to sound as much like a human speaker as possible, or may be configured to be understandable to a listener without attempts to mimic a precise human voice.

A speech synthesis engine 914 may perform speech synthesis using one or more different methods. In one method of synthesis called unit selection, described further below, a unit selection engine 930 matches the symbolic linguistic representation created by the TTSFE 916 against a database of recorded speech, such as a database of a voice corpus. The unit selection engine 930 matches the symbolic linguistic representation against spoken audio units in the database. Matching units are selected and concatenated together to form a speech output. Each unit includes an audio waveform corresponding with a phonetic unit, such as a short .wav file of the specific sound, along with a description of the various acoustic features associated with the .wav file (such as its pitch, energy, etc.), as well as other information, such as where the phonetic unit appears in a word, sentence, or phrase, the neighboring phonetic units, etc. Using all the information in the unit database, a unit selection engine 930 may match units to the input text to create a natural sounding waveform. The unit database may include multiple examples of phonetic units to provide the system with many different options for concatenating units into speech. One benefit of unit selection is that, depending on the size of the database, a natural sounding speech output may be generated. As described above, the larger the unit database of the voice corpus, the more likely the system will be able to construct natural sounding speech.

In another method of synthesis called parametric synthesis parameters such as frequency, volume, noise, are varied by a parametric synthesis engine 932, digital signal processor or other audio generation device to create an artificial speech waveform output. Parametric synthesis uses a computerized voice generator, sometimes called a vocoder. Parametric synthesis may use an acoustic model and various statistical techniques to match a symbolic linguistic representation with desired output speech parameters. Parametric synthesis may include the ability to be accurate at high processing speeds, as well as the ability to process speech without large databases associated with unit selection, but also may produce an output speech quality that may not match that of unit selection. Unit selection and parametric techniques may be performed individually or combined together and/or combined with other synthesis techniques to produce speech audio output.

Parametric speech synthesis may be performed as follows. A TTS component 295 may include an acoustic model, or other models, which may convert a symbolic linguistic representation into a synthetic acoustic waveform of the text input based on audio signal manipulation. The acoustic model includes rules which may be used by the parametric synthesis engine 932 to assign specific audio waveform parameters to input phonetic units and/or prosodic annotations. The rules may be used to calculate a score representing a likelihood that a particular audio output parameter(s) (such as frequency, volume, etc.) corresponds to the portion of the input symbolic linguistic representation from the TTSFE 916.

The parametric synthesis engine 932 may use a number of techniques to match speech to be synthesized with input phonetic units and/or prosodic annotations. One common technique is using Hidden Markov Models (HMMs). HMMs may be used to determine probabilities that audio output should match textual input. HMMs may be used to translate from parameters from the linguistic and acoustic space to the parameters to be used by a vocoder (the digital voice encoder) to artificially synthesize the desired speech. Using HMMs, a number of states are presented, in which the states together represent one or more potential acoustic parameters to be output to the vocoder and each state is associated with a model, such as a Gaussian mixture model. Transitions between states may also have an associated probability, representing a likelihood that a current state may be reached from a previous state. Sounds to be output may be represented as paths between states of the HMM and multiple paths may represent multiple possible audio matches for the same input text. Each portion of text may be represented by multiple potential states corresponding to different known pronunciations of phonemes and their parts (such as the phoneme identity, stress, accent, position, etc.). An initial determination of a probability of a potential phoneme may be associated with one state. As new text is processed by the speech synthesis engine 914, the state may change or stay the same, based on the processing of the new text. For example, the pronunciation of a previously processed word might change based on later processed words. A Viterbi algorithm may be used to find the most likely sequence of states based on the processed text. The HMMs may generate speech in parametrized form including parameters such as fundamental frequency (f0), noise envelope, spectral envelope, etc. that are translated by a vocoder into audio segments. The output parameters may be configured for particular vocoders such as a STRAIGHT vocoder, TANDEM-STRAIGHT vocoder, HNM (harmonic plus noise) based vocoders, CELP (code-excited linear prediction) vocoders, GlottHMM vocoders, HSM (harmonic/stochastic model) vocoders, or others.

Figure 10:
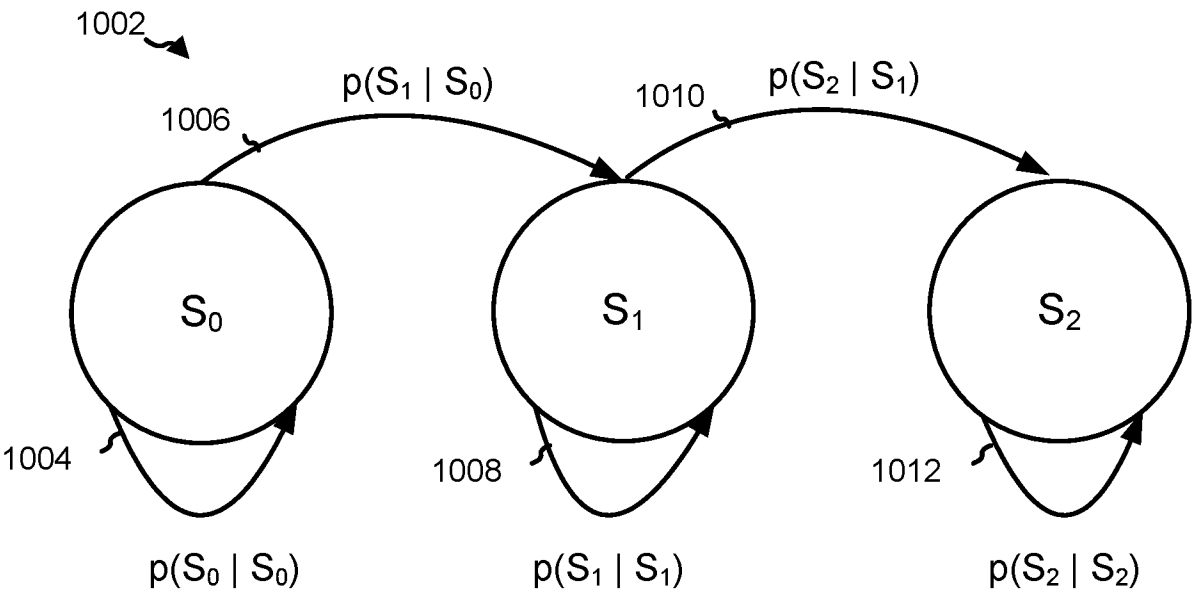
FIG. 10 illustrates speech synthesis using a Hidden Markov Model to perform text-to-speech (TTS) processing according to one aspect of the present disclosure.

An example of HMM processing for speech synthesis is shown in FIG. 10. A sample input phonetic unit, for example, phoneme /E/, may be processed by a parametric synthesis engine 932. The parametric synthesis engine 932 may initially assign a probability that the proper audio output associated with that phoneme is represented by state $S_0$ in the Hidden Markov Model illustrated in FIG. 10. After further processing, the speech synthesis engine 914 determines whether the state should either remain the same, or change to a new state. For example, whether the state should remain the same 1004 may depend on the corresponding transition probability (written as $P(S_0|S_0)$, meaning the probability of going from state $S_0$ to $S_0$) and how well the subsequent frame matches states $S_0$ and $S_1$. If state $S_1$ is the most probable, the calculations move to state $S_1$ and continue from there. For subsequent phonetic units, the speech synthesis engine 914 similarly determines whether the state should remain at $S_1$, using the transition probability represented by $P(S_1|S_1)$ 1008, or move to the next state, using the transition probability $P(S_2|S_1)$ 1010. As the processing continues, the parametric synthesis engine 932 continues calculating such probabilities including the probability 1012 of remaining in state $S_2$ or the probability of moving from a state of illustrated phoneme /E/ to a state of another phoneme. After processing the phonetic units and acoustic features for state $S_2$, the speech recognition may move to the next phonetic unit in the input text.

The probabilities and states may be calculated using a number of techniques. For example, probabilities for each state may be calculated using a Gaussian model, Gaussian mixture model, or other technique based on the feature vectors and the contents of the TTS storage 920. Techniques such as maximum likelihood estimation (MLE) may be used to estimate the probability of particular states.

In addition to calculating potential states for one audio waveform as a potential match to a phonetic unit, the parametric synthesis engine 932 may also calculate potential states for other potential audio outputs (such as various ways of pronouncing phoneme /E/) as potential acoustic matches for the phonetic unit. In this manner multiple states and state transition probabilities may be calculated.

The probable states and probable state transitions calculated by the parametric synthesis engine 932 may lead to a number of potential audio output sequences. Based on the acoustic model and other potential models, the potential audio output sequences may be scored according to a confidence level of the parametric synthesis engine 932. The highest scoring audio output sequence, including a stream of parameters to be synthesized, may be chosen and digital signal processing may be performed by a vocoder or similar component to create an audio output including synthesized speech waveforms corresponding to the parameters of the highest scoring audio output sequence and, if the proper sequence was selected, also corresponding to the input text.

Unit selection speech synthesis may be performed as follows. Unit selection includes a two-step process. First a unit selection engine 930 determines what speech units to use and then it combines them so that the particular combined units match the desired phonemes and acoustic features and create the desired speech output. Units may be selected based on a cost function which represents how well particular units fit the speech segments to be synthesized. The cost function may represent a combination of different costs representing different aspects of how well a particular speech unit may work for a particular speech segment. For example, a target cost indicates how well a given speech unit matches the features of a desired speech output (e.g., pitch, prosody, etc.). A join cost represents how well a speech unit matches a consecutive speech unit for purposes of concatenating the speech units together in the eventual synthesized speech. The overall cost function is a combination of target cost, join cost, and other costs that may be determined by the unit selection engine 930. As part of unit selection, the unit selection engine 930 chooses the speech unit with the lowest overall combined cost. For example, a speech unit with a very low target cost may not necessarily be selected if its join cost is high.

The system may be configured with one or more voice corpuses for unit selection. Each voice corpus may include a speech unit database. The speech unit database may be stored in TTS storage 920 or in another storage component. For example, different unit selection databases may be stored in TTS voice unit storage 372. Each speech unit database includes recorded speech utterances with the utterances' corresponding text aligned to the utterances. A speech unit database may include many hours of recorded speech (in the form of audio waveforms, feature vectors, or other formats), which may occupy a significant amount of storage. The unit samples in the speech unit database may be classified in a variety of ways including by phonetic unit (phoneme, diphone, word, etc.), linguistic prosodic label, acoustic feature sequence, speaker identity, etc. The sample utterances may be used to create mathematical models corresponding to desired audio output for particular speech units. When matching a symbolic linguistic representation the speech synthesis engine 914 may attempt to select a unit in the speech unit database that most closely matches the input text (including both phonetic units and prosodic annotations). Generally the larger the voice corpus/speech unit database the better the speech synthesis may be achieved by virtue of the greater number of unit samples that may be selected to form the precise desired speech output. An example of how unit selection is performed is illustrated in FIGS. 11A and 11B.

Figure 11A:
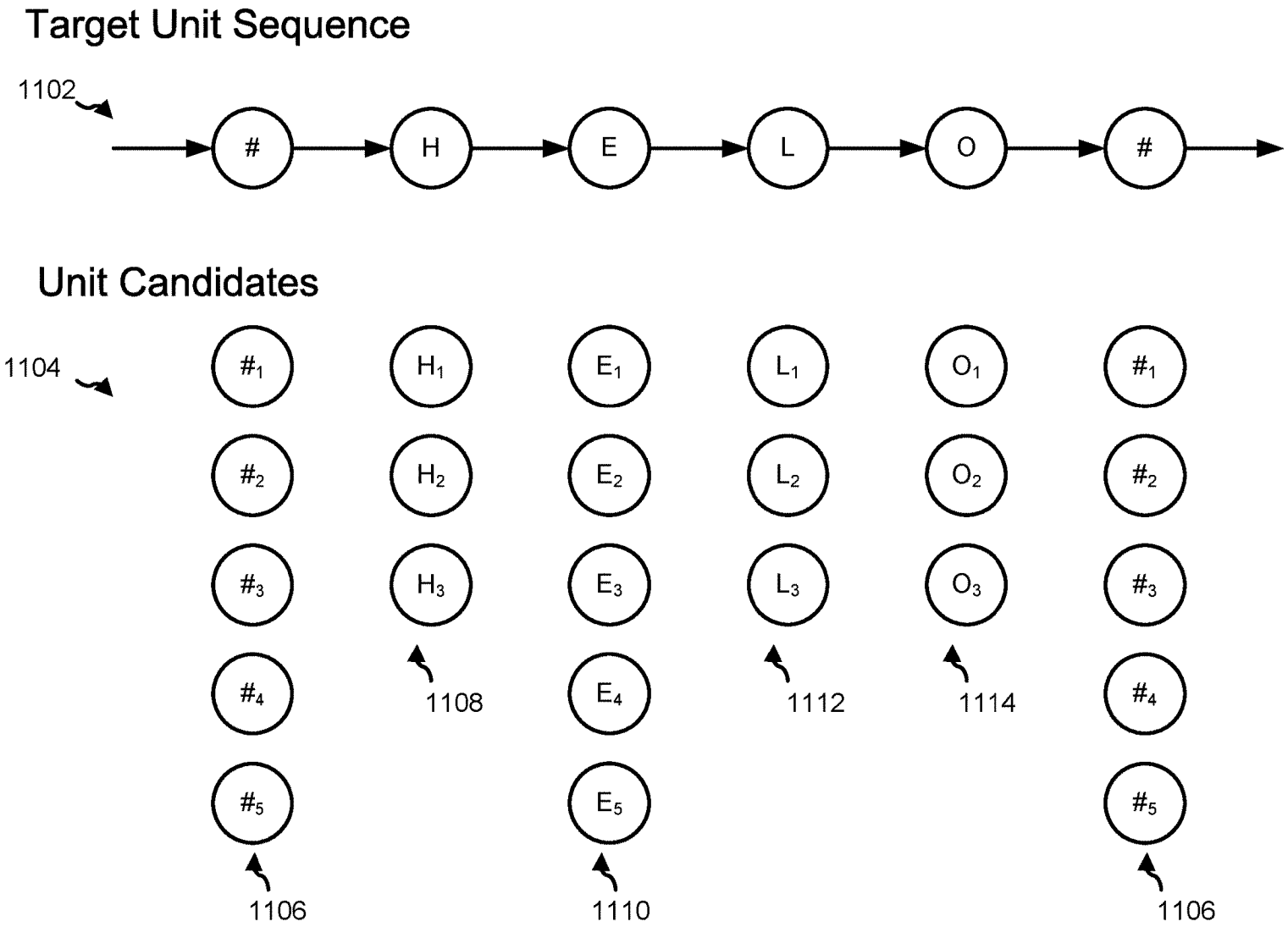
FIGS. 11A and 11B illustrate speech synthesis using unit selection according to one aspect of the present disclosure.
Figure 11B:
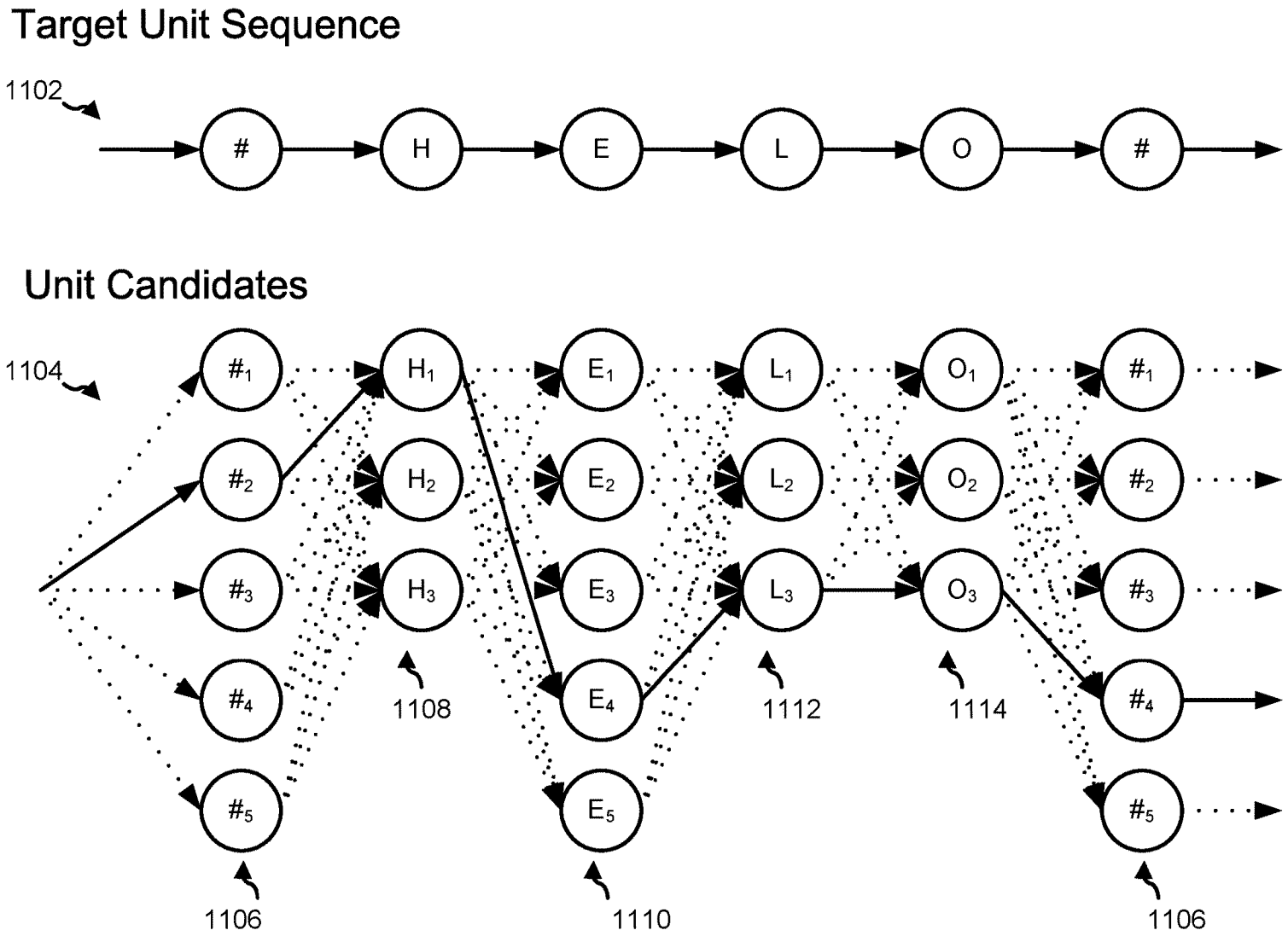

For example, as shown in FIG. 11A, a target sequence of phonetic units 1102 to synthesize the word "hello" is determined by a TTS device. As illustrated, the phonetic units 1102 are individual phonemes, though other units, such as diphones, etc. may be used. A number of candidate units 1104 may be stored in the voice corpus. Although phonemes are illustrated in FIG. 11A, other phonetic units, such as diphones, may be selected and used for unit selection speech synthesis. For each phonetic unit there are a number of potential candidate units (represented by columns 1106, 1108, 1110, 1112 and 1114) available. Each candidate unit represents a particular recording of the phonetic unit with a particular associated set of acoustic and linguistic features. The TTS system then creates a graph of potential sequences of candidate units to synthesize the available speech. The size of this graph may be variable based on certain device settings. An example of this graph is shown in FIG. 11B. A number of potential paths through the graph are illustrated by the different dotted lines connecting the candidate units. A Viterbi algorithm may be used to determine potential paths through the graph. Each path may be given a score incorporating both how well the candidate units match the target units (with a high score representing a low target cost of the candidate units) and how well the candidate units concatenate together in an eventual synthesized sequence (with a high score representing a low join cost of those respective candidate units). The TTS system may select the sequence that has the lowest overall cost (represented by a combination of target costs and join costs) or may choose a sequence based on customized functions for target cost, join cost or other factors. The candidate units along the selected path through the graph may then be combined together to form an output audio waveform representing the speech of the input text. For example, in FIG. 11B the selected path is represented by the solid line. Thus units $\#_2$, $H_1$, $E_4$, $L_3$, $O_3$, and $\#_4$ may be selected, and their respective audio concatenated, to synthesize audio for the word "hello."

Audio waveforms including the speech output from the TTS component 295 may be sent to an audio output component, such as a speaker for playback to a user or may be sent for transmission to another device, such as another server 120, for further processing or output to a user. Audio waveforms including the speech may be sent in a number of different formats such as a series of feature vectors, uncompressed audio data, or compressed audio data. For example, audio speech output may be encoded and/or compressed by an encoder/decoder (not shown) prior to transmission. The encoder/decoder may be customized for encoding and decoding speech data, such as digitized audio data, feature vectors, etc. The encoder/decoder may also encode non-TTS data of the system, for example using a general encoding scheme such as .zip, etc.

A TTS component 295 may be configured to perform TTS processing in multiple languages. For each language, the TTS component 295 may include specially configured data, instructions and/or components to synthesize speech in the desired language(s). To improve performance, the TTS component 295 may revise/update the contents of the TTS storage 920 based on feedback of the results of TTS processing, thus enabling the TTS component 295 to improve speech recognition.

Other information may also be stored in the TTS storage 920 for use in speech recognition. The contents of the TTS storage 920 may be prepared for general TTS use or may be customized to include sounds and words that are likely to be used in a particular application. As noted above, the TTS storage 920 may be customized for an individual user based on his/her individualized desired speech output. In particular, the speech unit stored in a unit database may be taken from input audio data of the user speaking.

For example, to create the customized speech output of the system, the system may be configured with multiple voice inventories 978*a*-978*n*, where each unit database is configured with a different "voice" to match desired speech qualities. Such voice inventories may also be linked to user accounts. The voice selected by the TTS component 295 to synthesize the speech. For example, one voice corpus may be stored to be used to synthesize whispered speech (or speech approximating whispered speech), another may be stored to be used to synthesize excited speech (or speech approximating excited speech), and so on. To create the different voice corpuses a multitude of TTS training utterances may be spoken by an individual and recorded by the system. The TTS training utterances used to train a TTS voice corpus may be different from the training utterances used to train an ASR system or the models used by the speech quality detector. The audio associated with the TTS training utterances may then be split into small audio segments and stored as part of a voice corpus. The individual speaking the TTS training utterances may speak in different voice qualities to create the customized voice corpuses, for example the individual may whisper the training utterances, say them in an excited voice, and so on. Thus the audio of each customized voice corpus may match the respective desired speech quality. The customized voice inventory 378 may then be used during runtime to perform unit selection to synthesize speech having a speech quality corresponding to the input speech quality.

Additionally, parametric synthesis may be used to synthesize speech with the desired speech quality. For parametric synthesis, parametric features may be configured that match the desired speech quality. If simulated excited speech was desired, parametric features may indicate an increased speech rate and/or pitch for the resulting speech. Many other examples are possible. The desired parametric features for particular speech qualities may be stored in a "voice" profile and used for speech synthesis when the specific speech quality is desired. Customized voices may be created based on multiple desired speech qualities combined (for both unit selection or parametric synthesis). For example, one voice may be "shouted" while another voice may be "shouted and emphasized." Many such combinations are possible.

As an alternative to customized voice corpuses or customized parametric "voices," one or more filters may be used to alter traditional TTS output to match the desired one or more speech qualities. For example, a TTS component 295 may synthesize speech as normal, but the system (either as part of the TTS component 295 or otherwise) may apply a filter to make the synthesized speech sound take on the desired speech quality. In this manner a traditional TTS output may be altered to take on the desired speech quality.

Various machine learning techniques may be used to train and operate models to perform various steps described above, such as user recognition feature extraction, encoding, user recognition scoring, user recognition confidence determination, etc. Models may be trained and operated according to various machine learning techniques. Such techniques may include, for example, neural networks (such as deep neural networks and/or recurrent neural networks), inference engines, trained classifiers, etc. Examples of trained classifiers include Support Vector Machines (SVMs), neural networks, decision trees, AdaBoost (short for "Adaptive Boosting") combined with decision trees, and random forests. Focusing on SVM as an example, SVM is a supervised learning model with associated learning algorithms that analyze data and recognize patterns in the data, and which are commonly used for classification and regression analysis. Given a set of training examples, each marked as belonging to one of two categories, an SVM training algorithm builds a model that assigns new examples into one category or the other, making it a non-probabilistic binary linear classifier. More complex SVM models may be built with the training set identifying more than two categories, with the SVM determining which category is most similar to input data. An SVM model may be mapped so that the examples of the separate categories are divided by clear gaps. New examples are then mapped into that same space and predicted to belong to a category based on which side of the gaps they fall on. Classifiers may issue a "score" indicating which category the data most closely matches. The score may provide an indication of how closely the data matches the category.

In order to apply the machine learning techniques, the machine learning processes themselves need to be trained. Training a machine learning component such as, in this case, one of the first or second models, requires establishing a "ground truth" for the training examples. In machine learning, the term "ground truth" refers to the accuracy of a training set's classification for supervised learning techniques. Various techniques may be used to train the models including backpropagation, statistical learning, supervised learning, semi-supervised learning, stochastic learning, or other known techniques.

A machine learning model may be configured to perform training of the speech model using the feature vectors and/or the extracted features from the portions of text data. The feature data from the portions of text data and/or the feature vectors may be trained to build up a mathematical model representing the corresponding human speech. Many statistical models and parameter training algorithms can be used, including but not limited to Hidden Markov Model (HMM), SVM (Support Vector Machine), Deep Learning, Neural Networks, or the like.

The TTS component or TTS engine may implement a model trained using machine learning techniques to determine output audio data representing the speech. Individual feature vector(s) may be used by the TTS engine (such as by a trained model being operated by the TTS engine) to synthesize speech for one text portion that incorporates information about characteristics about another text portion. For example, the TTS models may include recurrent Neural Networks with a certain number of layers. The feature vector for a particular text portion (which may be generated as a latent representation of that text portion) may be used as an input for prediction of the next text portion. This way, during the prediction of a current text portion, the feature vector/embedding is generated and the next text portion prediction can be started, before the current one has been finished.

The encoder 220 and/or TTS models may be trained using training examples that link a training text example with how the training text example should sound when read aloud. Thus the system may encode a relationship between the text and the ultimate audio so that a resulting feature vector (e.g., feature vector 250) for a particular text portion represents how the text portion may sound. The encoder 220 and/or TTS models may be trained jointly or separately.

Figure 12A:
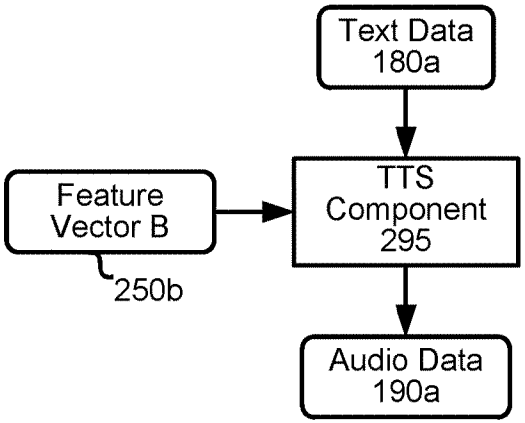
FIGS. 12A-12D illustrate TTS processing using feature vectors according to embodiments of the present disclosure.

As shown in FIGS. 12A-12D, a speech synthesis engine 914 may consider text data from a text portion that is being synthesized as well as a feature vector representing characteristics from a portion that is not currently being synthesized. (While not illustrated, the speech synthesis engine 914 may also consider characteristics/a feature vector for the text portion that is being synthesized.) For example, as shown in FIG. 12A, text data 180*a* corresponding to a first text portion A may be input into a speech synthesis engine 914. To create audio data 190*a* corresponding to the first text portion A, the speech synthesis engine 914 may consider not only the text data 180*a* but also feature vector B 250*b* which represents characteristics of a second text portion. The second text portion may come before or after the first text portion. The second text portion may also be adjacent to the first text portion or there may be one or more text portions between the first and second text portions. While creating the audio data 190*a*, the speech synthesis engine 914 may thus consider the characteristics/feature vector of the second text portion. This may assist in creating audio data 190*a* for the first text portion that has similar characteristics to audio data 190*b* for the second text portion so that the audio data for the respective text portions is not created in a manner that is disconnected from each other.

Figure 12B:
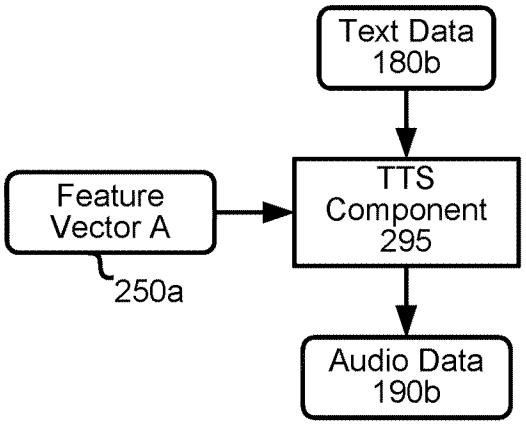

As further shown in FIG. 12B, to create audio data 190*b* corresponding to the second text portion B, the speech synthesis engine 914 may consider not only the text data 180*b* but also feature vector A 250*a* which represents characteristics of the first text portion.

Figure 12C:
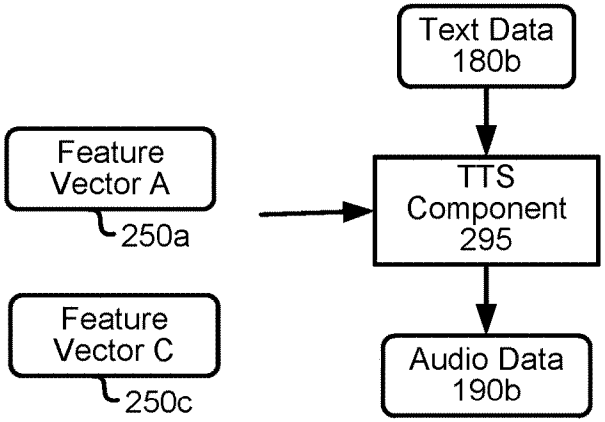
Figure 12D:
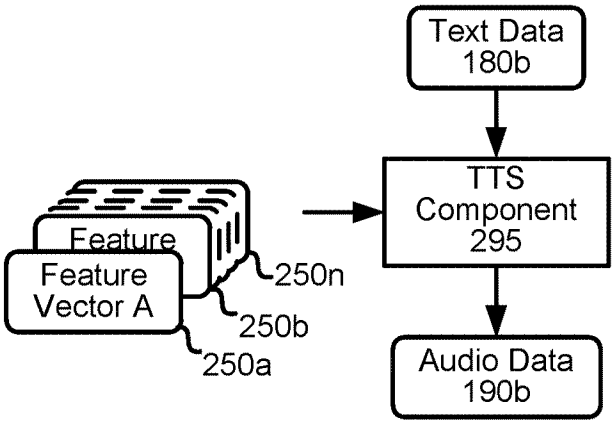

Multiple feature vectors of other text portions may also be considered when synthesizing text for a particular portion. For example, as shown in FIG. 12C, to create audio data 190*b* corresponding to a second text portion B, the speech synthesis engine 914 may consider not only the text data 180*b* but also feature vector A 250*a* which represents characteristics of a first text portion as well as feature vector C 250*c* which represents characteristics of a third text portion. The first and third text portions may both appear before the second text portion in a work or may both appear after the second text portion in a work. Or, the first text portion may appear before the second text portion and the third text portion may appear after the second text portion. The first and third text portions may also directly surround the second text portion in the work. In another example, as shown in FIG. 12D, to create audio data 190*b* corresponding to a second text portion B, the speech synthesis engine 914 may consider not only the text data 180*b* but also feature vectors A through N 250*a*-250*n* which represents characteristics of various other text portions, which may be all of, or some subset of, the feature vectors corresponding to other portions of a work that includes the second text portion.

By considering the characteristics of other text portions while performing TTS processing, the system may create audio data for a first text portion that shares one or more audio characteristics (such as tone, pace, volume, expression, etc.) with audio data for a second text portion, thus resulting in more pleasing ultimate TTS output.

Portions of text data and feature vectors corresponding to at least one of the portions may be used as the input to the models, however the synthesis may be carried out segment by segment. The acoustic models used in the TTS component may be recurrent Neural Networks with a certain number of layers. The system may use a segment embedding (generated as a latent representation of that segment) and use the embedding of the segment as an input to the prediction for the next segment or next portion of text data. This way, during the prediction of the current segment, the sentence embedding is generated and the next segment prediction can be started, before the current one has been finished. Segments may be embedded recursively, such that segments from different positions in the text data may be used during different stages of the prediction process.

Figure 13:
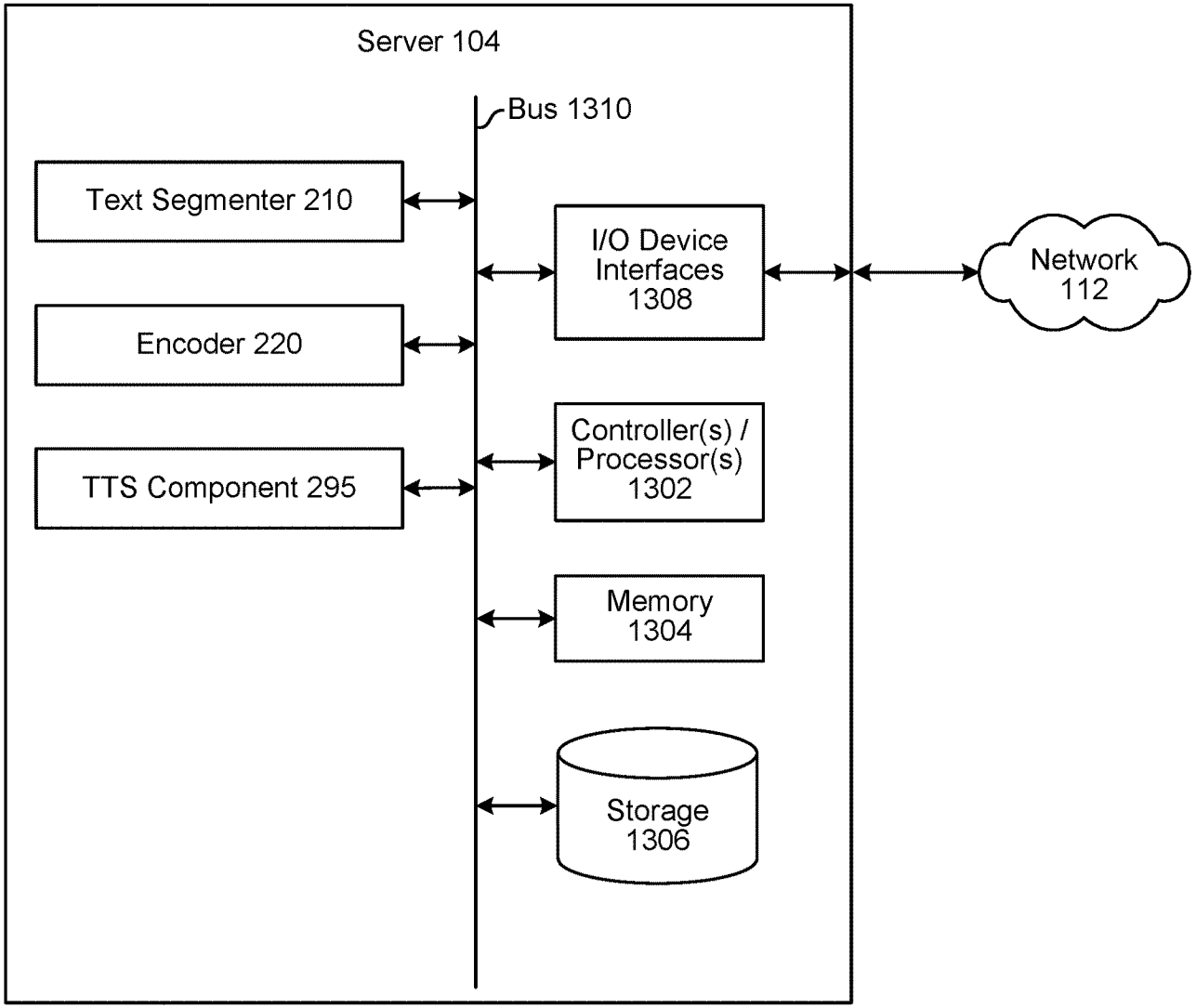
FIG. 13 illustrates is a block diagram conceptually illustrating example components of a remote device, such as server(s), that may be used with the system according to embodiments of the present disclosure.

Although the above discusses a system, one or more components of the system may reside on any number of devices. FIG. 13 is a block diagram conceptually illustrating example components of a remote device, such as server(s) 104, that may determine which portion of a textual work to perform TTS processing on and perform TTS processing to provide an audio output. Multiple such servers 104 may be included in the system, such as one server 104 for determining the portion of the textual to process using TTS processing, one server 104 for performing TTS processing, etc. In operation, each of these devices may include computer-readable and computer-executable instructions that reside on the server(s) 104, as will be discussed further below.

Each of server 104 may include one or more controllers/processors (1302), that may each include a central processing unit (CPU) for processing data and computer-readable instructions, and a memory (1304) for storing data and instructions of the respective device. The memories (1304) may individually include volatile random access memory (RAM), non-volatile read only memory (ROM), non-volatile magnetoresistive (MRAM) and/or other types of memory. Each server may also include a data storage component (1306), for storing data and controller/processor-executable instructions. Each data storage component may individually include one or more non-volatile storage types such as magnetic storage, optical storage, solid-state storage, etc. Each device may also be connected to removable or external non-volatile memory and/or storage (such as a removable memory card, memory key drive, networked storage, etc.) through respective input/output device interfaces (1308). The storage component 1306 may include storage for various data including ASR models, NLU knowledge base, entity library, speech quality models, TTS voice unit storage, and other storage used to operate the system.

Computer instructions for operating each server (104) and its various components may be executed by the respective server's controller(s)/processor(s) (1302), using the memory (1304) as temporary "working" storage at runtime. A server's computer instructions may be stored in a non-transitory manner in non-volatile memory (1304), storage (1306), or an external device(s). Alternatively, some or all of the executable instructions may be embedded in hardware or firmware on the respective device in addition to or instead of software.

Each server (104) includes input/output device interfaces (1108/1308). A variety of components may be connected through the input/output device interfaces, as will be discussed further below. Additionally, each server (104) may include an address/data bus (1110/1310) for conveying data among components of the respective device. Each component within a server (104) may also be directly connected to other components in addition to (or instead of) being connected to other components across the bus (1110/1310).

One or more servers 104 may include the text segmenter 210, encoder 220, TTS component 295, or other components capable of performing the functions described above.

As described above, the storage component 1306 may include storage for various data including ASR models, NLU knowledge base, entity library, speech quality models, TTS voice unit storage, and other storage used to operate the system and perform the algorithms and methods described above. The storage component 1306 may also store information corresponding to a user profile, including purchases of the user, returns of the user, recent content accessed, etc.

As noted above, multiple devices may be employed in a single system. In such a multi-device system, each of the devices may include different components for performing different aspects of the system. The multiple devices may include overlapping components. The components of the devices 102 and server(s) 104, as described with reference to FIG. 13, are exemplary, and may be located a stand-alone device or may be included, in whole or in part, as a component of a larger device or system.

Figure 14:
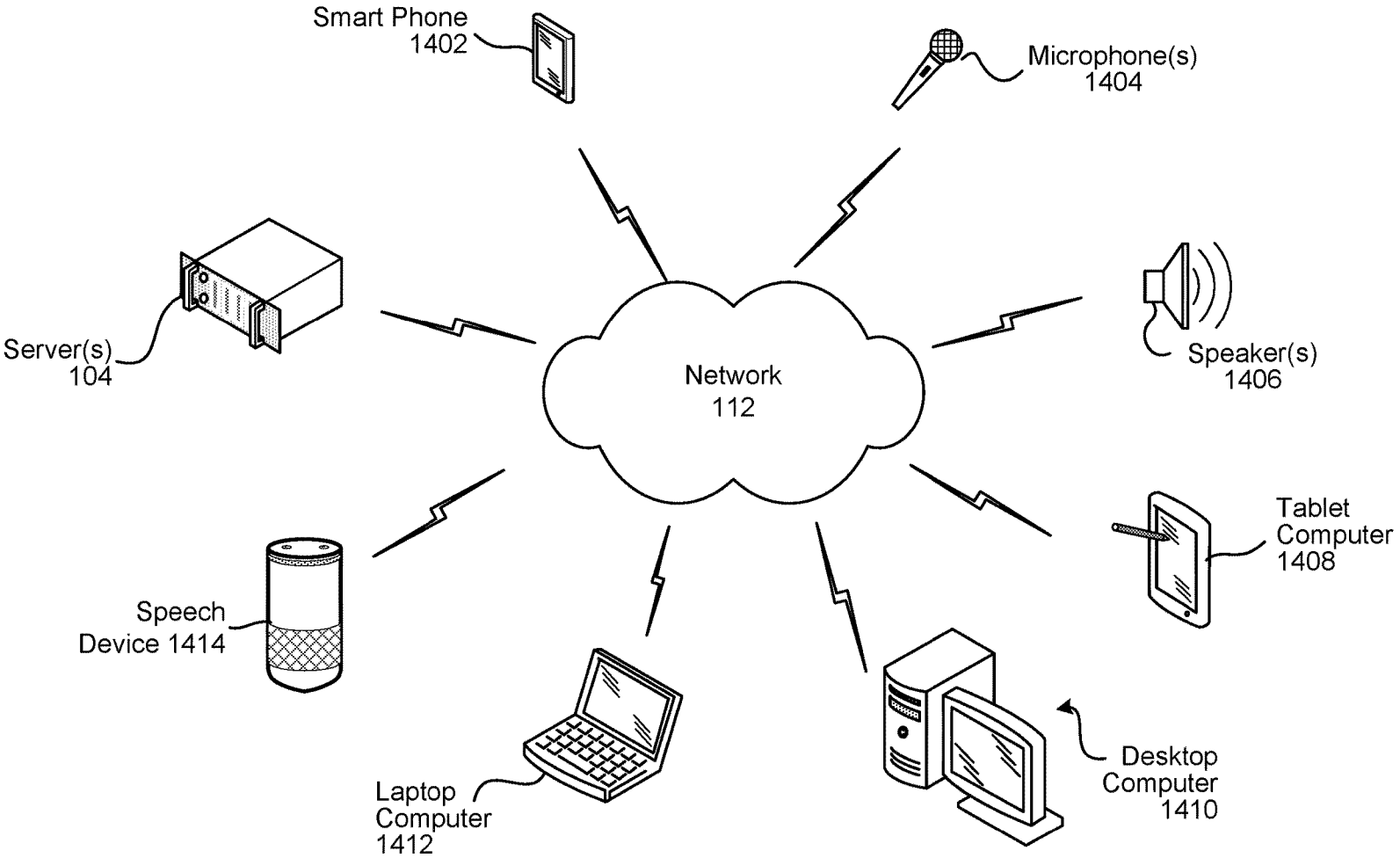
FIG. 14 illustrates a diagram conceptually illustrating distributed computing environment according to embodiments of the present disclosure.

As illustrated in FIG. 14, multiple devices may contain components of the system and the devices may be connected over a network 112. The network 112 is representative of any type of communication network, including data and/or voice network, and may be implemented using wired infrastructure (e.g., cable, CATS, fiber optic cable, etc.), a wireless infrastructure (e.g., WiFi, RF, cellular, microwave, satellite, Bluetooth, etc.), and/or other connection technologies. Devices may thus be connected to the network 112 through either wired or wireless connections. Network 112 may include a local or private network or may include a wide network such as the internet. For example, server(s) 104, smart phone 1402, networked microphone(s) 1404, networked audio output speaker(s) 1406, tablet computer 1408, desktop computer 1410, laptop computer 1412, speech device 1414, etc. may be connected to the network 112 through a wireless service provider, over a WiFi or cellular network connection or the like.

As described above, a device, may be associated with a user profile. For example, the device may be associated with a user identification (ID) number or other profile information linking the device to a user account. The user account/ID/profile may be used by the system to perform speech controlled commands (for example commands discussed above). The user account/ID/profile may be associated with particular model(s) or other information used to identify received audio, classify received audio (for example as a specific sound described above), determine user intent, determine user purchase history, content accessed by or relevant to the user, etc.

The concepts disclosed herein may be applied within a number of different devices and computer systems, including, for example, general-purpose computing systems, speech processing systems, and distributed computing environments.

The above aspects of the present disclosure are meant to be illustrative. They were chosen to explain the principles and application of the disclosure and are not intended to be exhaustive or to limit the disclosure. Many modifications and variations of the disclosed aspects may be apparent to those of skill in the art. Persons having ordinary skill in the field of computers and speech processing should recognize that components and process steps described herein may be interchangeable with other components or steps, or combinations of components or steps, and still achieve the benefits and advantages of the present disclosure. Moreover, it should be apparent to one skilled in the art, that the disclosure may be practiced without some or all of the specific details and steps disclosed herein.

Aspects of the disclosed system may be implemented as a computer method or as an article of manufacture such as a memory device or non-transitory computer readable storage medium. The computer readable storage medium may be readable by a computer and may comprise instructions for causing a computer or other device to perform processes described in the present disclosure. The computer readable storage media may be implemented by a volatile computer memory, non-volatile computer memory, hard drive, solid-state memory, flash drive, removable disk and/or other media. In addition, components of one or more of the components, components and engines may be implemented as in firmware or hardware, including digital filters (e.g., filters configured as firmware to a digital signal processor (DSP)).

As used in this disclosure, the term "a" or "one" may include one or more items unless specifically stated otherwise. Further, the phrase "based on" is intended to mean "based at least in part on" unless specifically stated otherwise.

The concepts disclosed herein may be applied within a number of different devices and computer systems, including, for example, general-purpose computing systems, speech processing systems, and distributed computing environments.

The above aspects of the present disclosure are meant to be illustrative. They were chosen to explain the principles and application of the disclosure and are not intended to be exhaustive or to limit the disclosure. Many modifications and variations of the disclosed aspects may be apparent to those of skill in the art. Persons having ordinary skill in the field of computers and speech processing should recognize that components and process steps described herein may be interchangeable with other components or steps, or combinations of components or steps, and still achieve the benefits and advantages of the present disclosure. Moreover, it should be apparent to one skilled in the art, that the disclosure may be practiced without some or all of the specific details and steps disclosed herein.

Aspects of the disclosed system may be implemented as a computer method or as an article of manufacture such as a memory device or non-transitory computer readable storage medium. The computer readable storage medium may be readable by a computer and may comprise instructions for causing a computer or other device to perform processes described in the present disclosure. The computer readable storage media may be implemented by a volatile computer memory, non-volatile computer memory, hard drive, solid-state memory, flash drive, removable disk and/or other media. In addition, components of one or more of the components and engines may be implemented as in firmware or hardware, such as the acoustic front end 256, which comprise among other things, analog and/or digital filters (e.g., filters configured as firmware to a digital signal processor (DSP)).

As used in this disclosure, the term "a" or "one" may include one or more items unless specifically stated otherwise. Further, the phrase "based on" is intended to mean "based at least in part on" unless specifically stated otherwise.

What is claimed is:

1. A computer-implemented method comprising:

receiving text data including a first text portion, a second text portion and a third text portion, the first text portion representing a first plurality of words, the second text portion representing a second plurality of words, and the third text portion representing a third plurality of words;

determining the first text portion and the second text portion correspond to a first contextual section;

determining the third text portion corresponds to a second contextual section different from the first contextual section;

based at least in part on the first text portion and the second text portion corresponding to the first contextual section, and the third text portion corresponding to the second contextual section, determining to perform text-to-speech (TTS) processing with respect to the first text portion using contextual information from the second text portion rather than the third text portion;

processing the first text portion to determine first data corresponding to a representation of the first plurality of words;

processing the second text portion to determine second data representing context information corresponding to the second text portion; and performing TTS processing using the first data and the second data to determine audio data corresponding to the first text portion.

2. The computer-implemented method of claim 1, further comprising:

determining the first text portion and the second text portion correspond to a first dialogue section; and determining the third text portion corresponds to a second dialogue section, wherein the TTS processing uses the second data in response to the first text portion and the second text portion corresponding to the first dialogue section.

3. The computer-implemented method of claim 1, further comprising:

determining that the first text portion corresponds to a first paragraph; and determining that the second text portion corresponds to a second paragraph contiguous with the first paragraph, wherein the TTS processing uses the second data in response to the second text portion corresponding to the second paragraph contiguous with the first paragraph.

4. The computer-implemented method of claim 3, further comprising:

determining an indication corresponding to a paragraph break, wherein performing the TTS processing further uses the indication.

5. The computer-implemented method of claim 1, further comprising:

determining that a total of the first plurality of words and the second plurality of words exceeds a threshold number of words, wherein the TTS processing uses the second data in response to the total exceeding the threshold number of words.

6. The computer-implemented method of claim 1, further comprising:

determining that the first text portion corresponds to a chapter heading for a first chapter;

determining that the second text portion corresponds to a text within the first chapter; and determining an indication corresponding to a chapter heading pause, wherein performing the TTS processing further uses the indication.

7. The computer-implemented method of claim 1, further comprising:

receiving second text data including a fourth text portion representing a fourth plurality of words;

determining the first text portion, the second text portion, and the fourth text portion correspond to a first contextual section; and processing the second text data to determine third data representing second context information corresponding to the fourth text portion, wherein performing the TTS processing further uses the third data.

8. The computer-implemented method of claim 1, further comprising:

determining that a first total of the first plurality of words and the second plurality of words does not exceed a threshold number of words;

receiving second text data including a fourth text portion representing a fourth plurality of words;

determining that a second total of the first plurality of words, the second plurality of words, and the fourth plurality of words exceeds the threshold number of words; and processing the second text data to determine third data representing second context information corresponding to the fourth text portion, wherein the TTS processing further uses the third data in response to the second total exceeding the threshold number of words.

9. The computer-implemented method of claim 1, further comprising:

processing the second text portion to determine third data corresponding to a representation of the second plurality of words;

processing the first text portion to determine fourth data representing context information corresponding to the first text portion; and performing TTS processing using the third data and the fourth data to determine second audio data corresponding to the second text portion.

10. A system, comprising:

at least one processor;

at least one memory comprising instructions that, when executed by the at least one processor, cause the system to:

receive text data including a first text portion, a second text portion and a third text portion, the first text portion representing a first plurality of words, the second text portion representing a second plurality of words, and the third text portion representing a third plurality of words;

determine the first text portion and the second text portion correspond to a first contextual section;

determine the third text portion corresponds to a second contextual section different than the first contextual section;

based at least in part on the first text portion and the second text portion corresponding to the first contextual section, and the third text portion corresponding to the second contextual section, determine to perform text-to-speech (TTS) processing with respect to the first text portion using contextual information from the second text portion rather than the third text portion;

process the first text portion to determine first data corresponding to a representation of the first plurality of words;

process the second text portion to determine second data representing context information corresponding to the second text portion; and perform TTS processing using the first data and the second data to determine audio data corresponding to the first text portion.

11. The system of claim 10, wherein the at least one memory further comprises instructions that, when executed by the at least one processor, further cause the system to:

determine the first text portion and the second text portion correspond to a first dialogue section; and determine the third text portion corresponds to a second dialogue section, wherein the TTS processing uses the second data in response to the first text portion and the second text portion corresponding to the first dialogue section.

12. The system of claim 10, wherein the at least one memory further comprises instructions that, when executed by the at least one processor, further cause the system to:

determine that the first text portion corresponds to a first paragraph; and determine that the second text portion corresponds to a second paragraph contiguous with the first paragraph, wherein the TTS processing uses the second data in response to the second text portion corresponding to the second paragraph contiguous with the first paragraph.

13. The system of claim 12, wherein the at least one memory further comprises instructions that, when executed by the at least one processor, further cause the system to:

determine an indication corresponding to a paragraph break, wherein the TTS processing further uses the indication.

14. The system of claim 10, wherein the at least one memory further comprises instructions that, when executed by the at least one processor, further cause the system to:

determine that a total of the first plurality of words and the second plurality of words exceeds a threshold number of words, wherein the TTS processing uses the second data in response to the total exceeding the threshold number of words.

15. The system of claim 10, wherein the at least one memory further comprises instructions that, when executed by the at least one processor, further cause the system to:

determine that the first text portion corresponds to a chapter heading for a first chapter;

determine that the second text portion corresponds to a text within the first chapter; and determine an indication corresponding to a chapter heading pause, wherein the TTS processing further uses the indication.

16. The system of claim 10, wherein the at least one memory further comprises instructions that, when executed by the at least one processor, further cause the system to:

receive second text data including a fourth text portion representing a fourth plurality of words;

determine the first text portion, the second text portion, and the fourth text portion correspond to a first contextual section; and process the second text data to determine third data representing second context information corresponding to the fourth text portion, wherein the TTS processing further uses the third data.

17. The system of claim 10, wherein the at least one memory further comprises instructions that, when executed by the at least one processor, further cause the system to:

determine that a first total of the first plurality of words and the second plurality of words does not exceed a threshold number of words;

receive second text data including a fourth text portion representing a fourth plurality of words;

determine that a second total of the first plurality of words, the second plurality of words, and the fourth plurality of words exceeds the threshold number of words; and process the second text data to determine third data representing second context information corresponding to the fourth text portion, wherein the TTS processing further uses the third data in response to the second total exceeding the threshold number of words.

18. The system of claim 10, wherein the at least one memory further comprises instructions that, when executed by the at least one processor, further cause the system to:

process the second text portion to determine third data corresponding to a representation of the second plurality of words;

process the first text portion to determine fourth data representing context information corresponding to the first text portion; and perform TTS processing using the third data and the fourth data to determine second audio data corresponding to the second text portion.

* * * * *